US008147020B2

(12) United States Patent
Kariya

(10) Patent No.: US 8,147,020 B2
(45) Date of Patent: Apr. 3, 2012

(54) INK-JET RECORDING METHOD

(75) Inventor: Toshihiro Kariya, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 456 days.

(21) Appl. No.: 12/499,089

(22) Filed: Jul. 8, 2009

(65) Prior Publication Data

US 2010/0007687 A1 Jan. 14, 2010

(30) Foreign Application Priority Data

Jul. 10, 2008 (JP) ..... 2008-180237

(51) Int. Cl.
*B41J 29/38* (2006.01)

(52) U.S. Cl. ..... 347/14; 347/1; 347/2; 347/7; 347/15; 347/19; 347/21; 347/24; 347/95; 347/101

(58) Field of Classification Search ..... 347/1–2, 347/7, 14–15, 19, 21, 24, 95, 101
See application file for complete search history.

(56) References Cited

U.S. PATENT DOCUMENTS

| | | | | |
|---|---|---|---|---|
| 7,219,988 | B2 * | 5/2007 | Hanaki et al. | 347/100 |
| 7,883,201 | B2 * | 2/2011 | Yahiro | 347/103 |
| 7,992,990 | B2 * | 8/2011 | Yamashita et al. | 347/102 |
| 8,007,879 | B2 * | 8/2011 | Nakano | 428/32.21 |
| 2007/0222811 | A1 * | 9/2007 | Yanagi | 347/21 |
| 2008/0079769 | A1 * | 4/2008 | Yahiro | 347/21 |
| 2009/0153613 | A1 * | 6/2009 | Yamanobe | 347/21 |
| 2009/0162569 | A1 * | 6/2009 | Morohoshi et al. | 427/561 |
| 2009/0268002 | A1 * | 10/2009 | Houjou | 347/95 |

FOREIGN PATENT DOCUMENTS

| | | |
|---|---|---|
| JP | 1-63185 | 3/1989 |
| JP | 8-20159 | 1/1996 |
| JP | 8-20161 | 1/1996 |
| JP | 9-207424 | 8/1997 |
| JP | 3640369 | 4/2005 |
| JP | 2006-188045 | 7/2006 |

* cited by examiner

*Primary Examiner* — Ryan Lepisto
*Assistant Examiner* — Guy Anderson
(74) *Attorney, Agent, or Firm* — SOLARIS Intellectual Property Group, PLLC

(57) ABSTRACT

An ink-jet recording method is provided. The ink-jet recording method includes (i) supplying an aqueous treatment liquid containing a fixing agent for fixing the components contained in an aqueous ink, on an art paper or a coat paper, in an amount of from −50% to +30% with respect to the value of $\Delta V$ [ml/m$^2$] determined by the following formula (I), and (ii) recording an image by ejecting an aqueous ink containing a colorant, resin particles, an aqueous organic solvent and water, on the art paper or coat paper by an ink-jet method. In Formula (I), Vr represents a roughness index of the art paper or coat paper obtained from a measurement of liquid absorbability according to the Bristow method, and Vi represents an amount of transfer at the inflection point where the value of the absorption coefficient of the art paper or coat paper changes in the measurement of liquid absorbability according to the Bristow method.

$$\Delta V = Vi - Vr \qquad \text{Formula (I)}$$

10 Claims, No Drawings

INK-JET RECORDING METHOD

CROSS-REFERENCE TO RELATED APPLICATION

This Application claims priority under 35 USC 119 from Japanese Patent Application No. 2008-180237 filed on Jul. 10, 2008, the disclosure of which is incorporated by reference herein.

BACKGROUND OF THE INVENTION

1. Technical Field

The present invention relates to an ink-jet recording method for recording images by ejecting ink by an ink-jet method.

2. Description of the Related Art

Various methods have been proposed for image recording methods for recording color images in recent years. However, in all of these methods, there are still demands on the quality levels of recorded objects, for example, in relation to quality of image, texture, and curling properties after recording.

The ink-jet technique has been applied for office printers and household printers, and is recently increasingly being applied in the field of commercial printing. In the commercial printing field, printed sheets are required to have an appearance similar to that of general printing paper, rather than a surface that completely blocks penetration of ink solvent into the base paper such as that of a photograph. However, when a solvent absorption layer of a recording medium has a thickness from 20 μm to 30 μm, the ranges of properties such as surface gloss, texture and stiffness are limited. Therefore, the application of ink-jet techniques in commercial printing has been limited to, for example, posters and forms, for which restrictions on surface gloss, texture, stiffness and the like are tolerable.

Furthermore, a recording medium for exclusive use in ink-jet recording is expensive since it is provided with a solvent absorbing layer and a water resistant layer, and this is also a factor that limits the application of ink-jet technology in the field of commercial printing.

As an ink-jet recording method for forming high quality images, a number of image recording methods in which a liquid composition for improving images is used in addition to an usual ink-jet ink, and the liquid composition is deposited on a recording medium prior to the ejection of the ink-jet ink, have been proposed (see, for example, Japanese Patent Application Laid-Open (JP-A) Nos. 9-207424 and 2006-188045). In these methods, the components of the ink-jet ink are aggregated on the surface of paper under the action of the fixing component in the ink, and thus the ink is fixed before dullness or bleeding occurs.

There is also disclosed a method for forming images by depositing a liquid composition which contains a cationic substance as a compound which makes the dye in the ink insoluble, on a region for image formation of ordinary paper by an ink-jet recording technique, and then jetting out a dye-containing ink on the area where the liquid composition has been deposited, also by an ink-jet recording technique, thereby performing printing (see, for example, JP-A Nos. 64-63185, 8-20159, and 8-20161).

There has also been disclosed a method for recording images by supplying an image recording accelerating agent on ordinary paper in an amount of 0.1 to 10 g/m$^2$ using a coating roller (see, for example, Japanese Patent No. 3640369).

SUMMARY OF THE INVENTION

However, in the method for forming images by printing with an ink on a region for image formation where the above-described liquid composition has been deposited, the amount of moisture at an area in which two colors are overlapped is large, and therefore, there arises a problem in that bleeding at the color boundaries cannot be sufficiently suppressed, and cockling of the recording medium material occurs. Also, since a liquid composition containing a cationic substance is sprayed from an ink-jet head, in order to obtain a stable jetting performance, the viscosity or surface tension of the liquid has to be limited, and in order to prevent clogging, the diameter of the nozzle or the composition of the liquid must also be limited, so that the degree of freedom is markedly small.

If the aggregation reaction between the liquid composition and the ink components is insufficient, image irregularities may be caused, and particularly when a solid image of two or more overlapping colors is recorded, image irregularities are conspicuous. If the amount of the liquid composition deposited is increased, the aggregation reaction accelerates, but the original appearance of the recording medium is impaired because of deterioration of abrasion resistance, a decrease in the surface glossiness of non-image areas, or the like.

Furthermore, in the above-described method for recording images by supplying an image recording accelerating agent with a coating roller, there still remains a problem in that the surface glossiness at the non-image areas of the recording medium changes, and a satisfactory appearance cannot be maintained.

The invention has been made in view of such circumstances, and provides an ink-jet recording method.

The present inventors have found the followings. That is, when recording images by supplying an ink and a treatment liquid for aggregating the ink on an art paper or a coat paper, since the art paper and coat paper, which are both coated papers, both include a base paper and a coating layer, due to the difference between the penetration of the treatment liquid into the base paper and the penetration of the treatment liquid into the coating layer, the adequate amount of treatment liquid for image recording may be decided in accordance with the characteristics (particularly, absorption capacity) of the art paper or the coat paper, and the amount of the treatment liquid is considered as one of the factors that determine whether the image would be satisfactory or unsatisfactory. The inventors have also found that the relationship between these characteristics and the amount of treatment liquid are involved in the factors for obtaining the quality of image (for example, the uniformity of the density or the like of solid images, fineness such as reproducibility for fine lines or fine image portions, uniformity) and the abrasion resistance of images without impairing the original appearance of the recording medium. The present invention has been made based on these findings.

According to an aspect of the present invention, an ink-jet recording method is provided. The ink-jet recording method of an aspect of the present invention includes (i) supplying an aqueous treatment liquid containing a fixing agent for fixing the components contained in an aqueous ink, on an art paper or a coat paper, in an amount of from −50% to +30% with respect to the value of ΔV [ml/m$^2$] determined by the following Formula (I), and (ii) recording an image by ejecting an aqueous ink containing a colorant, resin particles, a water-soluble organic solvent and water, on the art paper or coat paper by an ink-jet method.

$$\Delta V = Vi - Vr \qquad \text{Formula (I)}$$

In Formula (I), Vr represents a roughness index of the art paper or coat paper obtained from a measurement of liquid absorbability according to the Bristow method, and Vi represents an amount of transfer at an inflection point where the value of the absorption coefficient of the art paper or coat paper changes in the measurement of liquid absorbability according to the Bristow method.

DETAILED DESCRIPTION OF THE INVENTION

Hereinafter, the ink-jet recording method of the present invention will be described in detail.

The ink-jet recording method of the invention includes supplying an aqueous treatment liquid containing a fixing agent for fixing the components contained in an aqueous ink, on an art paper or a coat paper, in an amount of from −50% to +30% with respect to the value of ΔV [ml/m$^2$] determined by the following Formula (I) (treatment liquid supplying step); and recording an image by ejecting an aqueous ink containing a colorant, resin particles, a water-soluble organic solvent and water, on the art paper or coat paper by an ink-jet method (image recording step). The ink-jet recording method of the present invention may further include other steps such as heating and drying, as necessary.

$$\Delta V = Vi - Vr \qquad \text{Formula (I)}$$

In Formula (I), Vr is a roughness index [ml/m$^2$] of the art paper or coat paper obtained from a measurement of liquid absorbability according to the Bristow method, and Vi is an amount of transfer [ml/m$^2$] at an inflection point where the value of the absorption coefficient of the art paper or coat paper changes in the measurement of liquid absorbability according to the Bristow method.

According to the invention, when an image is recorded on a so-called coated paper, specifically an art paper or a coat paper, as a recording medium, using an aqueous ink, and an aqueous treatment liquid containing a fixing agent, which is an aggregating component for aggregating the components in the aqueous ink, if the amount of the aqueous treatment liquid is selected in view of the point (inflection point) where the absorption capacity, which is a capacity that the aqueous treatment liquid is absorbed from the paper surface into the interior of the art paper or coat paper, greatly changes in the course of the absorption capacity overtime, the aggregation reaction may be efficiently used to rapidly perform image fixation. By doing so, fine lines and fine image portions may be finely and uniformly formed, without damaging the final image surface due to alteration of the paper surface properties such as causing surface roughness. Also, when ink is supplied in a large area, such as in the case of solid image recording, occurrence of irregularities may be suppressed and images with high density uniformity may be obtained, and at the same time, the glossiness and abrasion resistance (adhesiveness to paper) of the image may also be enhanced. Further, high density image recording is also possible, and the color reproducibility of images also may become favorable.

The Bristow method is a method used for the measurement of the amount of liquid absorption in a short time, and is also employed by Japan Technical Association of the Pulp and Paper Industry (J'TAPPI). Details of the testing method can be referred to the descriptions in the J. TAPPI Paper and Pulp Test Method No. 51, "Method for determining the liquid absorbability of paper and board" (Bristow method), the disclosure of which is incorporated by reference herein, and in Japan TAPPI Journal, 41(8), 57 to 61 (1987), the disclosure of which is incorporated by reference herein. For the measurement according to the Bristow method, a testing apparatus (Bristow tester) described in the above references is used and the measurements are performed for the different contact time points while the contact time is allowed to elapse. In the measurement, the head box slit width for the Bristow tester is adjusted in accordance with the surface tension of ink. The measurement value for the contact time point at which ink runs off to the back of the paper, is excluded from the calculation.

The roughness index Vr of the art paper or coat paper (hereinafter, simply referred to as "coated paper") determined by the Bristow method is a point obtained by extrapolating the results to zero contact time, and indicates the amount of liquid needed to level the unevenness on the surface of the art paper or coat paper. Vr is a value specific to the art paper or coat paper, irrespective of absorption, and Vr is known to have a tendency to be correlated with the surface roughness measured by other methods.

The absorption coefficient indicates a ratio of the aqueous treatment liquid being absorbed over time, and is related to the rate of liquid absorption.

When a coated paper is measured by the Bristow method, there exists an inflection point at which the absorption coefficient changes. The inflection point at which the value of the absorption coefficient changes, refers to the point at which a penetration behavior, such as the penetration rate obtained when the aqueous treatment liquid penetrates from the coating layer of the coated paper into the base paper, which is the inner layer, with a certain absorption coefficient, changes; that is, in the case where the relationship of the elapsed time versus the amount of transfer is indicated using the horizontal axis for time and the vertical axis for the amount of the aqueous treatment liquid absorption (amount of transfer), the point at which, after a lapse of a certain time, the degree of decreases or increases in the amount of transfer becomes larger compared with before, and the absorption line inflects.

ΔV, which is determined by Formula (I) from the roughness index, Vr, and the amount of transfer of the aqueous treatment liquid at the inflection point, Vi, is considered as nearly the amount of liquid absorbed only by the pores of the coating layer.

In the present invention, the aqueous treatment liquid is supplied in accordance with the ΔV value of the coated paper, which is the recording medium, and specifically, the treatment liquid is supplied in an amount in the range of −50% or more and +30% or less of the ΔV value of the art paper or coat paper. Further, it is preferable to supply the aqueous treatment liquid in an amount in the range of −30% or more and +20% or less of the ΔV value of the coated paper. According to the present invention, the amount of supply is important from the viewpoint of embedding the pores of the coated paper, and the concentration of the aqueous treatment liquid may be appropriately selected in accordance with the purpose or the like. The concentration of the fixing agent in the aqueous treatment liquid will be described below.

When the amount of the aqueous treatment liquid supplied to the recording medium is increased, the resolution becomes higher. However, when the amount of aqueous treatment liquid is too large (>ΔV+30%), the aqueous treatment liquid may remain on the paper surface and may ruin the paper surface. Thus, when a solid image is recorded, the appearance possessed by the coated paper may be largely altered, such that streaks become prominent, the glossiness is reduced. Also, if the amount of the aqueous treatment liquid supplied to the recording medium is too small (<ΔV−50%), the treatment liquid may be excessively absorbed by the base paper layer, and the aggregation efficiency may be decreased, with the resolution of the image being deteriorated. In particular, when the amount of supply is less than ΔV−70%, the efficiency of the reaction between the aqueous treatment liquid and the ink may be extremely decreased.

The amount of the aqueous treatment liquid supplied to the recording medium is preferably in the range of from 0.5 $ml/m^2$ to 3.5 $ml/m^2$.

<Recording Medium>

In the ink-jet recording method of the invention, a coat paper or an art paper, which are together so-called coated papers and are used in general offset printing or the like, is used as a recording medium. The coat paper or art paper is a product obtained by applying a coating material on the surface of a high quality paper, a neutral paper or the like, which is mainly made of cellulose and is generally not surface-treated, to provide a coating layer.

These general printing papers cause problems in the product quality, such as bleeding of image or abrasion resistance, in the conventional image formation involving aqueous ink-jet ink, but in the ink-jet recording method of the invention, the image bleeding may be suppressed, and the generation of density irregularity may be prevented so that images with density uniformity can be formed, and images having satisfactory abrasion resistance may be recorded.

As the coat paper and art paper, those which are commercially available may be used. For example, a coated paper for general printing may be used, and specific examples thereof include coat papers (A2, B2) such as "OK TOPCOAT+" manufactured by Oji Paper Co., Ltd., "AURORACOAT" and "U-LITE" manufactured by Japan Paper Group, Inc.; and art paper (A1) such as "TOKUBISHI ART" manufactured by Mitsubishi Paper Mills, Ltd.

In the ink-jet recording method of the invention, any of the treatment liquid supplying step and the image recording step may be carried out ahead of the other. In view of drawing fine lines, fine image portions or the like more finely and uniformly, or in view of minimizing the occurrence of irregularities when ink is to be supplied in a large area such as in the case of solid image recording, to further increase the density uniformity and thereby further enhancing the image quality and abrasion resistance, a recording method in which the treatment liquid supplying step (preferably, supplying the aqueous treatment liquid on paper (preferably, over the entire surface of paper) by coating) is carried out, followed by the image recording step, is preferred.

—Treatment Liquid Supplying Step—

In the treatment liquid supplying step according to the invention, an aqueous treatment liquid which contains a fixing agent for fixing the components present in an aqueous ink that will be described later, and is used in an amount of −50% or more and +30% or less with respect to the value of ΔV [$ml/m^2$] determined by Formula (I), is supplied on an art paper or a coat paper. By using an aqueous ink in the presence of the aqueous treatment liquid, suppressive effects on the occurrence of curling and cockling of the medium after recording, and of ink splatter may also be obtained, and images having satisfactory abrasion resistance may be recorded.

(Aqueous Treatment Liquid)

The aqueous treatment liquid according to the present invention contains at least one fixing agent for fixing the components contained in the aqueous ink. The fixing agent according to the invention is an agent capable of fixing (aggregating) the aqueous ink by contacting with the aqueous ink on a paper. For example, when the fixing agent is provided on the paper by supplying the aqueous treatment liquid, and the aqueous ink is spotted thereon and contacts with the fixing agent, the fixing agent may aggregate the components contained in the aqueous and fix the components on the paper.

Since it is preferable that the fixing agent be capable of fixing (aggregating) an aqueous ink, the fixing agent is preferably a material which easily dissolves in the aqueous ink when contacting with the aqueous ink, and from this point of view, polyvalent metal salts that have a high water-solubility are more preferred, and an acidic substances that have a high water-solubility are even more preferred. Also, from the viewpoint of reacting with the aqueous ink and fixing the whole ink, di- or higher valent acidic substances are particularly preferred. As the fixing agent, cationic compounds may also be used.

Here, the aggregation reaction of the aqueous ink may be achieved by decreasing the dispersion stability of the particles dispersed in the aqueous ink (colorants (for example, pigments), resin particles), and increasing the viscosity of the whole ink. For example, the dispersion stability may be decreased by reducing the surface charge of the particles in the ink, such as the pigments and resin particles, which have been stabilized in dispersion by means of weakly acidic functional groups such as a carboxyl group, by the reaction with an acidic substance having a lower pKa value. Therefore, the acidic substance as the fixing agent contained in the aqueous treatment liquid preferably has a low pKa value, has high solubility, and has a valency of two or greater. A divalent or trivalent acidic substance which has high buffering capability in a pH region lower than the pKa of the functional group (for example, a carboxyl group), which stabilizes the dispersion state of the particles in the ink, is more preferred.

Specific examples thereof include phosphoric acid, oxalic acid, malonic acid, succinic acid, citric acid, phthalic acid. Other acidic substances having a pKa and/or solubility that are similar to those of to these acids may be used.

Among these acidic substances, citric acid has high water retaining power and has a tendency of resulting in high physical strength of the aggregated ink, and thus citric acid is preferably used in systems where more mechanical properties are demanded. On the other hand, malonic acid has low water retaining power, and is preferably used in the case where quick drying of the treatment liquid is desired.

As such, the fixing agent may also be appropriately selected for use on the basis of secondary factors, apart from the ability to fix the aqueous ink.

Examples of the polyvalent metal salts include salts of an alkaline earth metal of Group 2 in the Periodic Table (for example, magnesium and calcium), salts of a transition metal of Group 3 in the Periodic Table (for example, lanthanum), salts of a cation of the elements of Group 13 in the Periodic Table (for example, aluminum), and salts of a lanthanide (for example, neodymium). As for the salts of any of these metals, carboxylic acid salts (for example, formic acid salts, acetic acid salts, and benzoic acid salts), nitrates, chlorides, and thiocyanates are suitable. Among them, preferred are a calcium salt or magnesium salt of a carboxylic acid (for example, formic acid, acetic acid, or benzoic acid), calcium salt or magnesium salt of nitric acid, calcium chloride, magnesium chloride, and calcium salt or magnesium salt of thiocyanic acid.

The cationic compound may be, for example, preferably a cationic surfactant. Preferred examples of the cationic surfactant include compounds of primary, secondary or tertiary amine salt type. Examples of these amine salt type compounds include compounds such as hydrochlorides or acetates (for example, laurylamine, palmitylamine, stearylamine, rosin amine), quaternary ammonium salt type compounds (for example, lauryltrimethylammonium chloride, cetyltrimethylammonium chloride, lauryldimethylbenzylammonium chloride, benzyltributylammonium chloride, benzalkonium chloride), pyridinium salt type compounds (for example, cetylpyridinium chloride, cetylpyridinium bromide), imidazoline type cationic compounds (for example, 2-heptadecenylhydroxyethylimidazoline), and ethylene oxide adducts of higher alkylamines (for example, dihydroxyethylstearylamine). Further, amphoteric surfactants exhibiting cationic properties in a desired pH region may also be used, examples of which include amino acid type amphoteric surfactants, R—NH—$CH_2CH_2$—COOH type compounds, carboxylic acid salt type amphoteric surfactants (for example, stearyldimethylbetaine, lauryldihydroxyethylbetaine), amphoteric surfactants of sulfuric acid ester type, sulfonic acid type or phosphoric acid ester type.

The fixing agent may be used as one kind, or as a mixture of two or more kinds.

The content of the fixing agent(s) for aqueous ink fixation in the aqueous treatment liquid is preferably in the range of 1 to 40% by mass, more preferably 5 to 30% by mass, and even more preferably 10 to 25% by mass.

(Other Components)

The aqueous treatment liquid according to the present invention may contain, in general, a water-soluble organic solvent in addition to the fixing agent, and may also contain various other additives. Details of the water-soluble organic solvent and the various other additives are similar to those for the aqueous ink that will be described later.

In regard to the supplying of the aqueous treatment liquid on paper, known liquid supplying methods may be used without any particular limitation, and any method may be selected. Examples of the method include spray coating, coating with a coating roller, supply by an ink-jet method, and immersion.

Specific examples of a liquid supplying method include size press methods represented by a horizontal size press method, a roll coater method, a calendar size press method or the like; size press methods represented by an air knife coater method or the like; knife coater methods represented by an air knife coater method; roll coater methods represented by a transfer roll coater method such as a gate roll coater method, a direct roll coater method, a reverse roll coater method, a squeeze roll coater method or the like; blade coater methods represented by a billblade coater method, a short dwell coater method, a two stream coater method; bar coater methods represented by a rod bar coater method; bar coater methods represented by a rod bar coater method; cast coater methods; gravure coater method; curtain coater methods; die coater methods; brush coater methods; transfer methods.

Furthermore, a method of coating in which the coating amount is controlled using a coating apparatus equipped with a liquid amount controlling member, as in the case of the coating apparatus described in JP-A No. 10-230201, may be used.

The aqueous treatment liquid may be supplied over the entire surface of the recording medium (an entire surface supply). The aqueous treatment liquid may be supplied to a region where ink-jet recording is performed in the subsequent image recording step (a partial supply). According to the invention, in view of uniformly adjusting the amount of supplying of the aqueous treatment liquid, uniformly recording fine lines, fine image portions or the like, and suppressing image irregularities such as density irregularity, an entire surface supply of supplying the aqueous treatment liquid over the entire surface of the recording medium by coating the liquid using a coating roller or the like, is preferred.

The amount of supply of the fixing agent is not particularly limited as long as it is an amount sufficient for stabilizing an aqueous ink, and is preferably 0.25 g/$m^2$ or more. From the viewpoint of ease of fixing the aqueous ink by aggregation, the amount is more preferably 0.30 g/$m^2$ or more and less than 2.0 g/$m^2$, and even more preferably 0.40 g/m or more and less than 1.0 g/$m^2$.

As for the method of coating the aqueous treatment liquid while controlling the amount of supply of the fixing agent to the above-described range, for example, a method of using an anilox roller may be suitably mentioned. The anilox roller is a roller in which the roller surface, being thermal spray coated with ceramics, is processed with laser and provided with a pattern of a pyramidal shape, a slant-lined shape, a hexagonal shape or the like on the surface. The aqueous treatment liquid goes into the depression areas provided on this roller surface, and when the roller surface contacts with the paper surface, transfer occurs, and the aqueous treatment liquid is coated in an amount that is controlled at the depressions of the anilox roller.

The surface tension (25° C.) of the aqueous treatment liquid is preferably 20 mN/m or more and 60 mN/m or less. More preferably, the surface tension is 25 mN/m or more and 50 mN/m or less, and is even more preferably 25 mN/m or more and 45 mN/m or less.

The surface tension of the aqueous treatment liquid is measured under the conditions of 25° C. using an automatic surface tension meter (model name: CBVP-Z, manufactured by Kyowa Interface Science Co., Ltd.).

The viscosity at 25° C. of the aqueous treatment liquid is preferably 1.2 mPa·s or more and 15.0 mPa·s or less, more preferably 2 mPa·s or more and 12 mPa·s or less, and even more preferably 2 mPa·s or more and 8 mPa·s or less, from the viewpoint of performing the coating stably in an amount in the range of from 0.5 ml/$m^2$ to 3.5 ml/$m^2$. Particularly, in the case of coating the aqueous treatment liquid on a paper, the viscosity (25° C.) is preferably from 2 mPa·s to 8 mPa·s, and more preferably from 2 mPa·s to 6 mPa·s.

The viscosity of the aqueous treatment liquid is measured under the conditions of 25° C. using a viscometer (model name: TV-22, manufactured by Toki Sangyo Co., Ltd.).

—Drying and Removal Step—

In the treatment liquid supplying step, it is preferable to provide a drying and removal step in which, after the supplying of the aqueous treatment liquid, the solvent contained in the aqueous treatment liquid is removed by drying. As the solvent in the aqueous treatment liquid is removed by drying after the supplying of the aqueous treatment liquid, the occurrence of curling, cockling or ink splatter is suppressed more effectively, the abrasion resistance of the recorded images may be further enhanced, and the recording of images may be performed more favorably.

The drying and removal step is not particularly limited, as long as at least a part of the solvent (for example, water or a water-soluble organic solvent) contained in the aqueous treatment liquid may be removed. The removal by drying may be carried out by, for example, a method of drying by heating, air blowing (blowing dry air, or the like).

—Image Recording Step—

The image recording step according to the invention involves recording an image by ejecting an aqueous ink containing a colorant, resin particles, a water-soluble organic solvent and water, onto an art paper or a coat paper by an ink-jet method.

Image recording by utilizing the ink-jet method can be performed by supplying energy thereby ejecting an aqueous ink to a coat paper or an art paper. Accordingly a colored image may be formed. In the ink-jet recording method of the present invention, for example, a method described in paragraphs 0093 to 0105 in JP-A No. 2003-306623 may be used as a preferable method.

The ink-jet method is not particularly limited and may be of any known system, for example, a charge control system of ejecting an ink by utilizing an electrostatic attraction force, a drop on demand system of utilizing a vibration pressure of a piezo element (pressure pulse system), an acoustic ink-jet system of converting electric signals into acoustic beams, irradiating them to an ink, and ejecting the ink by utilizing a radiation pressure, and a thermal ink-jet system of heating an ink to form bubbles and utilizing the resultant pressure (BUBBLEJET (registered trade mark)). As the ink-jet method, an ink-jet method described in JP-A No. 54-59936 of causing abrupt volume change to an ink that undergoes the effect of thermal energy, and ejecting the ink from a nozzle by an operation force due to the change of state can be utilized effectively.

Examples of the ink-jet method include a system of injecting a number of ink droplets of low concentration, a so-called "photo-ink" each in a small volume, a system of improving an image quality by using plural kinds of inks of a substantially identical hue and of different densities, and a system of using a colorless transparent ink.

The ink-jet head used in the ink-jet method may be either an on-demand system or a continuous system. Specific examples of the ejection system include an electric-mechanical conversion system (for example, single cavity type, double cavity type, bender type, piston type, share mode type, and shared wall type, etc.), an electric-thermal conversion system (for example, thermal ink-jet type, BUBBLEJET (registered trade mark) type, etc.), an electrostatic attraction system (for example, electric field control type, and slit jet type, etc.), and an electric discharge system (for example, spark jet type, etc.) and any of the ejection systems may be used.

Ink nozzles and the like used for recording by the ink-jet method are not particularly limited, and may be selected properly depending on the purpose.

(Aqueous Ink)

The aqueous ink (hereinafter, may also be simply referred to as "ink") according to the invention contains at least one colorant, at least one kind of resin particles, at least one water-soluble organic solvent, and water, and if necessary, may also include other components such as surfactants.

The aqueous ink may be used in the formation of monochromatic images as well as in the formation of polychromatic images (for example, full color images), and one color or two or more colors that are desired may be selected for image recording. In the case of forming full color images, a magenta tone ink, a cyan tone ink, and a yellow tone ink may be used as the aqueous ink. Furthermore, in order to adjust the color tones, a black tone ink may be used in addition.

Also, in addition to the yellow (Y), magenta (M) and cyan (C) tones, ink compositions of red (R), green (G), blue (B) and white (W) tones, or ink compositions of so-called special colors as used in the printing field may be used.

The aforementioned ink compositions of the respective color tones may be prepared by varying the color of the colorant (for example, pigment), as desired.

Details of the aqueous ink will be described later.

—Colorant—

The colorant may be any compound having a function by which colored images may be formed by coloration, and any of pigments, dyes or colored particles may be used as the colorant. Among the pigments, water-dispersible pigments are preferred.

Specific examples of the water-dispersible pigment include the following pigments of (1) to (4).

(1) An encapsulated pigment, that is, a polymer dispersion in which a pigment is incorporated in polymer particles. More specifically, the encapsulated pigment is a pigment coated with a hydrophilic and water-insoluble resin and has hydrophilicity due to the resin layer provided on the surface of the pigment, and therefore, the encapsulated pigment is dispersible in water.

(2) A self-dispersing pigment, that is, a pigment which has at least one hydrophilic group at the surface, and exhibits at least any of water-solubility and water-dispersibility in the absence of dispersant. More specifically, the self-dispersing pigment is a pigment produced mainly by subjecting carbon black or the like to a surface oxidation treatment to render the pigment hydrophilic, and thus making the pigment per se to disperse in water.

(3) A resin-dispersed pigment, that is, a pigment dispersed by a water-soluble polymer compound having a weight average molecular weight of 50,000 or less.

(4) A surfactant-dispersed pigment, that is, a pigment dispersed by a surfactant.

Among these, preferred are the (1) encapsulated pigment and (2) self-dispersing pigment, and particularly preferred is the (1) encapsulated pigment.

Here, the (1) encapsulated pigment will be described in detail.

The resin for the encapsulated pigment is not limited, but the resin is preferably a polymer compound having self-dispersing ability or dissolving ability in a mixed solvent of water and a water-soluble organic solvent, and having an anionic group (acidic). Usually, this resin preferably has a number average molecular weight in the range of about 1,000 to 100,000, and particularly in the range of about 3,000 to 50,000. It is also preferable that this resin be dissolved in an organic solvent to form a solution. When the number average molecular weight of the resin is within this range, the resin may exhibit its function as a coating layer for the pigment, or as a coating layer when used in an ink. The resin is preferably used in the form of a salt of an alkali metal or an organic amine.

Specific examples of the resin for the encapsulated pigment include materials having an anionic group, such as thermoplastic, thermosetting or modified acrylic, epoxy-based, polyurethane-based, polyether-based, polyamide-based, unsaturated polyester-based, phenolic, silicone-based or fluorine-based resins; polyvinyl-based resins such as vinyl chloride, vinyl acetate, polyvinyl alcohol or polyvinyl butyral; polyester-based resins such as alkyd resins and phthalic acid resins; amino-based materials such as melamine resins, melamine-formaldehyde resins, aminoalkyd co-condensated resins, urea resins, and urea resins; or copolymers or mixtures thereof.

The anionic acrylic resins may be obtained by, for example, polymerizing an acryl monomer having an anionic group (hereinafter, referred to as "anionic group-containing acryl monomer") and if necessary, another monomer capable of being copolymerized with the anionic group-containing acryl monomer, in a solvent. Examples of the anionic group-containing acryl monomer include acryl monomers having one or more anionic groups selected from the group consisting of a carboxyl group, a sulfonic acid group and a phosphonic acid group, and among them, acryl monomers having a carboxyl group are particularly preferred.

Specific examples of the acryl monomer having a carboxyl group include acrylic acid, methacrylic acid, crotonic acid, ethacrylic acid, propylacrylic acid, isopropylacrylic acid, itaconic acid, fumaric acid. Among these, acrylic acid or methacrylic acid is preferred.

The encapsulated pigment may be produced by a conventional physical or chemical method, using the above-described components. For example, the encapsulated pigment may be produced by the methods described in JP-A Nos. 9-151342, 10-140065, 11-209672, 11-172180, 10-25440 or 11-43636.

Specific examples of the method include the phase inversion emulsification method and acid precipitation method described in JP-A Nos. 9-151342 and 10-140065, respectively, and among them, the phase inversion emulsification method is preferred in view of dispersion stability. The phase inversion emulsification method and the acid precipitation method will be described later.

The aforementioned self-dispersing pigment is also one of preferred examples. The self-dispersing pigment is a pigment which has a large number of hydrophilic functional groups and/or salts thereof (hereinafter, referred to as "dispersibility imparting group") bonded to the pigment surface directly or indirectly via an alkyl group, an alkyl ether group, an aryl group or the like, and is capable of dispersing in an aqueous medium without using a dispersant for pigment dispersion. Here, the term "dispersing in an aqueous medium without using a dispersant" implies that the pigment is capable of being dispersed in an aqueous medium even though a dispersant for dispersing pigments is not used.

Since an ink containing a self-dispersing pigment as the colorant does not need to include a dispersant which is usually incorporated to disperse pigments, it is possible to easily prepare an ink in which foaming due to decrease in the defoaming property caused by the dispersant (that is, foaming associated with the use of the dispersant) scarcely occur, and which has excellent ejection stability. Examples of the dispersibility imparting group that is bonded to the surface of the self-dispersing pigment include —COOH, —CO, —OH, —$SO_3H$, —$PO_3H_2$ and quaternary ammonium, and salts thereof. The dispersibility imparting group may be bonded to the surface of the pigment by applying a physical treatment or a chemical treatment to the pigment, thereby bonding (grafting) the dispersibility imparting group or an active species having a dispersibility imparting group to the pigment surface. As the physical treatment, examples thereof include vacuum plasma treatment. Examples of the chemical treatment include a wet oxidation method of oxidizing the pigment surface in water by an oxidizing agent; a method of bonding a carboxyl group via a phenyl group by bonding p-aminobenzoic acid to the pigment surface.

The self-dispersing pigment may be, for example, a self-dispersing pigment which is surface treated by an oxidation treatment using hypohalous acid and/or hypohalite, or an oxidation treatment using ozone.

As the self-dispersing pigment, a commercially available product may be used, and examples of the commercially available self-dispersing pigment include MICROJET CW-1 (trade name; manufactured by Orient Chemical Industries, Ltd.), CAB-O-JET200, CAB-O-JET300 (trade name; manufactured by Cabot Corp.).

Here, the phase inversion emulsification method, and the acid precipitation method will be described.

a) Phase Inversion Emulsification Method

The phase inversion emulsification method is a self-dispersing (phase inversion emulsification) method in which a mixed molten product of a pigment and a resin having a self-dispersing ability or dissolving ability, is dispersed in water. This mixed molten product may include a curing agent or a polymer compound. Here, the mixed molten product may be a state in which ingredients are mixed but are not dissolved, a state in which ingredients are dissolved and mixed, or a state in which these two states are included. Specific examples of a production method of the "phase inversion emulsification method" include a method described in JP-A No. 10-140065.

b) Acid Precipitation Method

The acid precipitation method is a method in which a water-containing cake formed from a resin and a pigment is prepared, and a part or the entirety of the anionic groups included in the resin in the water-containing cake is neutralized using a basic compound, thereby producing a microencapsulated pigment.

Specific examples of the acid precipitation method include a method including: (1) a step of dispersing a resin and a pigment in an alkaline aqueous medium, and as necessary, performing a heat treatment to gelate the resin; (2) a step of hydrophobizing the resin by making the pH neutral or acidic, and strongly fixing the resin to the pigment; (3) a step of performing filtration and washing with water if necessary, to obtain a water-containing cake; (4) a step of partially or entirely neutralizing the anionic groups included in the resin in the water-containing cake using a basic compound, and then re-dispersing the resulting product in the aqueous medium; and (5) performing a heat treatment if necessary, to gelate the resin.

In regard to more specific methods of the phase inversion emulsification method and the acid precipitation method, reference may be made to the descriptions of JP-A Nos. 9-151342 and 10-140065.

<Pigment>

The pigment is not particularly limited, and may be appropriately selected according to the purpose, and for example, any of organic pigments and inorganic pigments may be included.

Examples of the organic pigments include azo pigments, polycyclic pigments, dye chelates, nitro pigments, nitroso pigments, aniline black. Among these, azo pigments, polycyclic pigments are more preferred.

For instance, examples of the azo pigments include azo lakes, insoluble azo pigments, condensed azo pigments, chelate azo pigments. Examples of the polycyclic pigments include phthalocyanine pigments, perylene pigments, perinone pigments, anthraquinone pigments, quinacridone pigments, dioxazine pigments, indigo pigments, thioindigo pigments, isoindolinone pigments, quinophthalone pigments. Examples of the dye chelates include basic dye type chelates, acidic dye type chelates.

Examples of the inorganic pigments include titanium oxide, iron oxide, calcium carbonate, barium sulfate, aluminum hydroxide, barium yellow, cadmium red, chrome yellow, carbon black. Among these, carbon black is particularly preferred.

Here, examples of carbon black include those produced according to any of known methods such as a contact method, a furnace method and a thermal method.

As for the black pigments, specific examples of carbon black include RAVEN 7000, RAVEN 5750, RAVEN 5250, RAVEN 5000 ULTRAII, RAVEN 3500, RAVEN 2000, RAVEN 1500, RAVEN 1250, RAVEN 1200, RAVEN 1190 ULTRAII, RAVEN 1170, RAVEN 1255, RAVEN 1080, RAVEN 1060, RAVEN 700 (all manufactured by Columbian Carbon Company), REGAL 400R, REGAL 330R, REGAL 660R, MOGUL L, BLACK PEARLS L, MONARCH 700, MONARCH 800, MONARCH 880, MONARCH 900, MONARCH 1000, MONARCH 1100, MONARCH 1300, MONARCH 1400 (all manufactured by Cabot Corp.), COLOR BLACK FW1, COLOR BLACK FW2, COLOR BLACK FW2V, COLOR BLACK 18, COLOR BLACK FW200, COLOR BLACK S150, COLOR BLACK S160, COLOR BLACK S170, PRINTEX 35, PRINTEX U, PRINTEX V, PRINTEX 140U, PRINTEX 140V, SPECIAL BLACK 6, SPECIAL BLACK 5, SPECIAL BLACK 4A, SPECIAL BLACK 4 (all manufactured by Degussa), No. 25, No. 33, No. 40, No. 45, No. 47, No. 52, No. 900, No. 2200B, No. 2300, MCF-88, MA 600, MA 7, MA 8, MA 100 (all manufactured by Mitsubishi Chemical Corp.). However, the examples are not intended to be limited to these.

As for the organic pigments, examples of the pigment for yellow ink include C.I. Pigment Yellow 1, 2, 3, 4, 5, 6, 7, 10, 11, 12, 13, 14, 14 C, 16, 17, 24, 34, 35, 37, 42, 53, 55, 65, 73, 74, 75, 81, 83, 93, 95, 97, 98, 100, 101, 104, 108, 109, 110, 114, 117, 120, 128, 129, 138, 150, 151, 153, 154, 155, 180.

Examples of the pigment for magenta ink include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 48 (Ca), 48 (Mn), 48:2, 48:3, 48:4, 49, 49:1, 50, 51, 52, 52:2, 53:1, 53, 55, 57 (Ca), 57:1, 60, 60:1, 63:1, 63:2, 64, 64:1, 81, 83, 87, 88, 89, 90, 101 (iron oxide), 104, 105, 106, 108 (Cadmium Red), 112, 114, 122 (Quinacridone Magenta), 123, 146, 149, 163, 166, 168, 170, 172, 177, 178, 179, 184, 185, 190, 193, 202, 209, 219, 269, and C.I. Pigment Violet 19. Among the pigments for magenta ink, C.I. Pigment Red 122 is preferred.

Examples of the pigment for cyan ink include C.I. Pigment Blue 1, 2, 3, 15, 15:1, 15:2, 15:3, 15:34, 16, 17:1, 22, 25, 56, 60, C.I. Vat Blue 4, 60, 63. Among the pigments for cyan ink, C.I. Pigment Blue 15:3 is preferred.

The aforementioned pigments may be used as one kind alone, or may be used in combination of two or more kinds selected from within the group or among the two or more groups.

The content of the colorant(s) (particularly, pigment) in the aqueous ink is preferably 1 to 25% by mass, and more preferably 2 to 20% by mass, relative to the total mass of the aqueous ink (including the colorant, resin particles, water-soluble organic solvent and water), from the viewpoint of color density, granularity, ink stability and ejection reliability.

<Dispersant>

In the case of using a water-dispersible pigment as the colorant, at least one dispersant may be used with the encapsulated pigment or resin-dispersed pigment. As the dispersant, a nonionic compound, an anionic compound, a cationic compound, an amphoteric compound, or the like may be used.

For example, a copolymer of monomers having an α,β-ethylenic unsaturated group may be used as the dispersant. Examples of the monomer having an α,β-ethylenic unsaturated group include ethylene, propylene, butane, pentene, hexane, vinyl acetate, allyl acetate, acrylic acid, methacrylic acid, crotonic acid, crotonic acid esters, itaconic acid, itaconic acid monoesters, maleic acid, maleic acid monoesters, maleic acid diesters, fumaric acid, fumaric acid monoesters, vinylsulfonic acid, styrenesulfonic acid, sulfonated vinylnaphthalene, vinyl alcohol, acrylamide, methacryloxyethyl phosphate, bismethacryloxyethyl phosphate, methacryloxyethylphenyl acid phosphate, ethylene glycol dimethacrylate, diethylene glycol dimethacrylate, styrene, styrene derivatives such as α-methylstyrene and vinyltoluene, vinylcyclohexane, vinylnaphthalene, vinylnaphthalene derivatives, acrylic acid alkyl esters which may have an aromatic group as a substituent, acrylic acid phenyl esters, methacrylic acid alkyl esters which may have an aromatic group as a substituent, methacrylic acid phenyl esters, methacrylic acid cycloalkyl esters, crotonic acid alkyl esters, itaconic acid dialkyl esters, maleic acid dialkyl esters, vinyl alcohol, and derivatives of the aforementioned compounds.

One monomer or two or more monomers of the above described monomer having an α,β-ethylenic unsaturated group may be used for copolymerization, and the resulting copolymer may be used as a polymeric dispersant. Specific examples of the copolymer include acrylic acid alkyl ester-acrylic acid copolymers, methacrylic acid alkyl ester-methacrylic acid copolymers, styrene-acrylic acid alkyl ester-acrylic acid copolymers, styrene-methacrylic acid phenyl ester-methacrylic acid copolymers, styrene-methacrylic acid cyclohexyl ester-methacrylic acid copolymers, styrene-styrenesulfonic acid copolymers, styrene-maleic acid copolymers, styrene-methacrylic acid copolymers, styrene-acrylic acid copolymers, vinylnaphthalene-maleic acid copolymers, vinylnaphthalene-methacrylic acid copolymers, vinylnaphthalene-acrylic acid copolymers, polystyrene, polyesters, and polyvinyl alcohol.

The dispersant preferably has a weight average molecular weight of 2,000 to 60,000.

The amount of addition of the dispersant with respect to the pigment is, on a mass basis, preferably in the range of 10% or more and 100% or less of the amount of the pigment, more preferably 20% or more and 70% or less of the amount of the pigment, and even more preferably 40% or more and 50% or less of the amount of the pigment.

<Water-Soluble Organic Solvent>

The aqueous ink according to the present invention contains at least one water-soluble organic solvent. The water-soluble organic solvent may give the effects of dryness prevention, wetting, or penetration acceleration. For the dryness prevention, the water-soluble organic solvent is used as a dryness preventing agent, which prevents the ink from adhering and being dried to form aggregates at the ink outlet of the ejection nozzle, and clogging the ink outlet. For the dryness prevention or wetting, a water-soluble organic solvent having a lower vapor pressure than that of water, is preferred. Also, for the acceleration of penetration, the water-soluble organic solvent may be used as a penetration accelerating agent, which enhances the penetrability of the ink into paper.

Examples of the water-soluble organic solvent include alkanediols or polyhydric alcohols, such as glycerin, 1,2,6-hexanetriol, trimethylolpropane, ethylene glycol, propylene glycol, diethylene glycol, triethylene glycol, tetraethylene glycol, pentaethylene glycol, dipropylene glycol, 2-butene-1,4-diol, 2-ethyl-1,3-hexanediol, 2-methyl-2,4-pentanediol, 1,2-octanediol, 1,2-hexanediol, 1,2-pentanediol, and 4-methyl-1,2-pentanediol; saccharides such as glucose, mannose, fructose, ribose, xylose, arabinose, galactose, aldonic acid, glucitol, maltose, cellobiose, lactose, sucrose, trehalose, and maltotriose; sugar alcohols; hyaluronic acids; so-called solid wetting agents such as ureas; alkyl alcohols having 1 to 4 carbon atoms, such as ethanol, methanol, butanol, propanol, and isopropanol; glycol ethers such as ethylene glycol monomethyl ether, ethylene glycol monoethyl ether, ethylene glycol monobutyl ether, ethylene glycol monomethyl ether acetate, diethylene glycol monomethyl ether, diethylene glycol monoethyl ether, diethylene glycol mono-n-propyl ether, ethylene glycol mono-isopropyl ether, diethylene glycol mono-isopropyl ether, ethylene glycol mono-n-butyl ether, ethylene glycol mono-t-butyl ether, diethylene glycol mono-t-butyl ether, 1-methyl-1-methoxybutanol, propylene glycol monomethyl ether, propylene glycol monoethyl ether, propylene glycol mono-t-butyl ether, propylene glycol mono-n-propyl ether, propylene glycol mono-isopropyl ether, dipropylene glycol monomethyl ether, dipropylene glycol monoethyl ether, dipropylne glycol mono-n-propyl ether, and dipropylene glycol mono-isopropyl ether; 2-pyrrolidone, N-methyl-2-pyrrolidone, 1,3-dimethyl-2-imidazolidinone, formamide, acetamide, dimethylsulfoxide, sorbite, sorbitan, acetin, diacetin, triacetin, sulfolane. These may be used as one kind alone, or in combination of two or more kinds.

For the purpose of dryness prevention or wetting, polyhydric alcohols are useful, and examples thereof include glycerin, ethylene glycol, diethylene glycol, triethylene glycol, propylene glycol, dipropylene glycol, tripropylene glycol, 1,3-butanediol, 2,3-butanediol, 1,4-butanediol, 3-methyl-1,3-butanediol, 1,5-pentanediol, tetraethylene glycol, 1,6-hexanediol, 2-methyl-2,4-pentanediol, polyethylene glycol, and 1,2,4-butanetriol, 1,2,6-hexanetriol. These may be used as one kind alone, or may be used in combination of two or more kinds.

For the purpose of penetration acceleration, polyol compounds are preferred, and aliphatic diols are suitable. Examples of the aliphatic diols include 2-ethyl-2-methyl-1,3-propanediol, 3,3-dimethyl-1,2-butanediol, 2,2-diethyl-1,3-propanediol, 2-methyl-2-propyl-1,3-propanediol, 2,4-dimethyl-2,4-pentanediol, 2,5-dimethyl-2,5-hexanediol, 5-hexene-1,2-diol, 2-ethyl-1,3-hexanediol. Among these, 2-ethyl-1,3-hexanediol and 2,2,4-trimethyl-1,3-pentanediol may be mentioned as preferred examples.

The water-soluble organic solvents may be used as one kind alone, or may be used as mixtures of two or more kinds.

The content of the water-soluble organic solvent(s) in the aqueous ink is preferably 1% by mass or more and 60% by mass or less, and more preferably 5% by mass or more and 40% by mass or less.

<Water>

The aqueous ink according to the invention contains water, and the amount of water is not particularly limited. The amount of water is preferably 10% by mass or more and 99% by mass or less, more preferably 30% by mass or more and 80% by mass or less, and even more preferably 50% by mass or more and 70% by mass or less.

<Resin Particles>

The aqueous ink according to the invention contains at least one kind of resin particles. When resin particles are contained, mainly the fixability of the aqueous ink to the recording medium and the abrasion resistance of the image may be further enhanced. The resin particles have a function of fixing the aqueous ink, that is, the image, by causing aggregation or dispersion unstabilization when contacted with the above-described aqueous treatment liquid or a paper region where the aqueous treatment liquid has been dried, and thereby increasing the viscosity of the ink. The resin particles are preferably dispersed in water and an organic solvent.

Examples of the resin particles that may be used include acrylic resins, vinyl acetate-based resins, styrene-butadiene-based resins, vinyl chloride-based resins, acryl-styrene-based resins, butadienic resins, styrenic resins, crosslinked acrylic resins, crosslinked styrenic resins, benzoguanamine resins, phenolic reins, silicone resins, epoxy resins, urethane-based resins, paraffin-based resins, fluororesins. Various kinds of resin particles of, for example, acrylic resins, acryl-styrene-based resins, styrenic resins, crosslinked acrylic resins, crosslinked styrenic resins may be used. Particularly, acrylic resin particles are preferred.

Acrylic resins are obtained by polymerizing, for example, an acryl monomer having an anionic group (anionic group-containing acryl monomer) and as necessary, another monomer capable of being copolymerized with the anionic group-containing acryl monomer. Examples of the anionic group-containing acryl monomer include acryl monomers having one or more selected from the group consisting of a carboxyl group, a sulfonic acid group and a phosphonic acid group. Among them, acryl monomers having a carboxyl group (for example, acrylic acid, methacrylic acid, crotonic acid, ethacrylic acid, propylacrylic acid, isopropylacrylic acid, itaconic acid, fumaric acid) are preferred, and acrylic acid or methacrylic acid is particularly preferred.

As the resin particles, specifically latexes may be suitably used, and for example, various latexes such as acrylic latexes, vinyl acetate-based latexes, styrenic latexes and polyester-based latexes, may be suitably used. Particularly, acrylic latexes are preferred.

As the resin particles in the invention, self-dispersing polymer particles are preferred and self-dispersing polymer particles having a carboxyl group are more preferred, from a view point of the ejection stability and the liquid stability (particularly, dispersion stability) in a case of using a coloring material (particularly, pigment), which will be described below. The self-dispersing polymer particles mean particles of a water-insoluble polymer which can form a dispersed state in an aqueous medium by means of a functional group (particularly, an acidic group or a salt thereof) of the polymer per se in the absence of other surfactant, and are water-insoluble polymer particles which do not contain an additional separate emulsifier.

The "dispersed state" includes an emulsified state where the water-insoluble polymer is dispersed in a liquid state in an aqueous medium (emulsion) and a dispersed state where the water-insoluble polymer is dispersed in a solid state in the aqueous medium (suspension).

The water-insoluble polymer in the invention is preferably such a water-insoluble polymer that can form a dispersed state where the water-insoluble polymer is dispersed in a solid state, from a view point of the aggregation speed and the fixing property when it is formulated as a liquid composition.

The dispersed state of the self-dispersing polymer particles means such a state where stable presence of a dispersed state can be confirmed visually at 25° C. for at least one week after mixing and stirring a solution in which 30 g of a water-insoluble polymer is dissolved into 70 g of an organic solvent (for example, methyl ethyl ketone), a neutralizing agent capable of neutralizing a salt-forming group of the water-insoluble polymer to 100% (sodium hydroxide when the salt forming group is anionic or acetic acid when the group is cationic), and 200 g of water (apparatus: a stirrer equipped with a stirring blade, number of rotation: 200 rpm, 30 min, 25° C.), and then removing the organic solvent from the liquid mixture.

Further, the water-insoluble polymer means a polymer showing an amount of dissolution of 10 g or less when the polymer is dried at 105° C. for 2 hours and then dissolved in 100 g of water at 25° C. The amount of dissolution is, preferably, 5 g or less and, more preferably, 1 g or less. The amount of dissolution is the amount of dissolution when the polymer is neutralized to 100% with sodium hydroxide or acetic acid in accordance with the kind of the salt-forming group of the water-insoluble polymer.

The aqueous medium contains water and may optionally contain a hydrophilic organic solvent. In the invention, the aqueous medium preferably includes water and the hydrophilic organic solvent in an amount of 0.2 mass % or less relative to water and, more preferably, the aqueous medium consists of water.

The main chain skeleton of the water-insoluble polymer is not particularly limited and, for example, a vinyl polymer or a condensated type polymer (epoxy resin, polyester, polyurethane, polyamide, cellulose, polyether, polyurea, polyimide, polycarbonate, etc.) can be used. Among them, a vinyl polymer is particularly preferred.

Preferred examples of the vinyl polymer and the monomer used for the vinyl polymer include those described in JP-A Nos. 2001-181549 and 2002-88294. Further, vinyl polymers introduced with a dissociative group to a terminal end of a polymer chain by radical polymerization of a vinyl monomer using a chain transfer agent, a polymerization initiator, or an iniferter having a dissociative group (or a substituent that can be induced to the dissociative group) or by ionic polymerization using a compound having a dissociative group (or substituent that can be induced to the dissociative group) to an initiator or a terminator can also be used.

Preferred examples of condensated type polymers and monomers used for the condensated type polymers include those described in JP-A No. 2001-247787.

The self-dispersing polymer particles preferably contain a water-insoluble polymer containing a hydrophilic constituent unit and a constituent unit derived from an aromatic group-containing monomer from a viewpoint of the self-dispersibility.

The hydrophilic constituent unit is not particularly limited so long as it is derived from a hydrophilic group-containing monomer and it may be either a unit derived from one kind of hydrophilic group-containing monomer or a unit derived from two or more kinds of hydrophilic group-containing monomers. The hydrophilic group is not particularly limited and it may be either a dissociative group or a nonionic hydrophilic group.

In the invention, the hydrophilic group is preferably a dissociative group from a view point of promoting the self-dispersibility and a view point of stability of the formed emulsified or dispersed state and, more preferably, an anionic dissociative group. Examples of the dissociative group include a carboxylic group, a phosphoric acid group, and a sulfonic acid group and, among them, the carboxylic group is preferred from a viewpoint of the fixing property when the ink composition is formed.

The hydrophilic group-containing monomer in the invention is preferably a dissociative group-containing monomer and, preferably, a dissociative group-containing monomer having a dissociative group and an ethylenically unsaturated bond from a viewpoint of the self-dispersibility and the aggregation property.

Examples of the dissociative group-containing monomer include an unsaturated carboxylic acid monomer, an unsaturated sulfonic acid monomer, and an unsaturated phosphoric acid monomer.

Specific examples of the unsaturated carboxylic acid monomer include acrylic acid, methacrylic acid, crotonic acid, itaconic acid, maleic acid, fumaric acid, citraconic acid, and 2-methacryloyloxy methyl succinic acid, etc. Specific examples of the unsaturated sulfonic acid monomer include styrene sulfonic acid, 2-acrylamide-2-methylpropane sulfonic acid, 3-sulfopropyl(meth)acrylate, and bis(3-sulfopropyl)-itaconic acid ester. Specific examples of the unsaturated phosphoric acid monomer include vinyl phosphonic acid, vinyl phosphate, bis(methacryloyloxyethyl) phosphate, diphenyl-2-acryloyloxyethyl phosphate, diphenyl-2-methacryloyloxyethyl phosphate, and dibutyl-2-acryloyloxyethyl phosphate.

Among the dissociative group-containing monomers, the unsaturated carboxylic acid monomer is preferred and, acrylic acid and methacrylic acid are more preferred from a viewpoint of the dispersion stability and the ejection stability.

The self-dispersibility polymer particles in the invention preferably contain a polymer having a carboxyl group and contains, more preferably, a polymer having a carboxylic group and an acid value (mgKOH/g) of from 25 to 100, from a viewpoint of the self-dispersibility and the aggregation speed when the liquid composition containing the polymer particles is in contact with a treating liquid. The acid value is, more preferably, from 25 to 80 and, particularly preferably, from 30 to 65, from a viewpoint of the self-dispersibility and the aggregation speed when the liquid composition containing the polymer particles is in contact with the treating liquid.

Particularly, when the acid value is 25 or more, the stability of the self-dispersibility may be more favorable, and when the acid value is 100 or less, the aggregation property may be improved.

The aromatic group-containing monomer is not particularly limited so long as it is a compound containing an aromatic group and a polymerizable group. The aromatic group may be either a group derived from an aromatic hydrocarbon or a group derived from an aromatic heterocyclic ring. In the invention, the aromatic group is preferably an aromatic group derived from the aromatic hydrocarbon, from a viewpoint of the shape stability of particles in the aqueous medium.

The polymerizable group may be either a polycondensating polymerizable group or an addition polymerizing polymerizable group. In the invention, the polymerizable group is preferably an addition polymerizing polymerizable group, and more preferably, a group containing an ethylenically unsaturated bond from a viewpoint of shape stability of particles in the aqueous medium.

The aromatic group-containing monomer in the invention is preferably a monomer having an aromatic group derived from an aromatic hydrocarbon and an ethylenically unsaturated bond. The aromatic group-containing monomer may be used as one kind alone or two or more kinds of the aromatic group-containing monomers may be used in combination.

Examples of the aromatic group-containing monomer include phenoxyethyl(meth)acrylate, benzyl(meth)acrylate, phenyl(meth)acrylate, and styrenic monomer. Among them, from a viewpoint of the balance between the hydrophilicity and the hydrophobicity of the polymer chain and the ink fixing property, an aromatic group-containing (meth)acrylate monomer is preferred, and at least one selected from the group consisting of phenoxyethyl(meth)acrylate, benzyl (meth)acrylate, and phenyl(meth)acrylate is more preferable and, phenoxyethyl(meth)acrylate and benzyl(meth)acrylate are still more preferred.

"(Meth)acrylate" means acrylate or methacrylate, "(meth) acrylamide" means acrylamide or methacrylamide, and "(meth)acrylic" means acrylic or methacrylic.

The self-dispersing polymer particles in the invention preferably contain a constituent unit derived from the aromatic group-containing (meth)acrylate monomer and the content thereof is, preferably, from 10 mass % to 95 mass %. When the content of the constituent unit derived from the aromatic group-containing (meth)acrylate monomer is from 10 mass % to 95 mass %, the stability of the self-emulsified or dispersed state is improved and, further, increase in the viscosity of an ink can be suppressed.

In the invention, the content of the constituent unit derived from the aromatic group-containing (meth)acrylate monomer in the self-dispersing polymer particles is, more preferably, from 15 mass % to 90 mass %, further preferably, from 15 mass % to 80 mass % and, particularly preferably, from 25 mass % to 70 mass % from a viewpoint of the stability of the self-dispersed state, stabilization for the shape of the particles in the aqueous medium due to hydrophobic inter-action between aromatic rings to each other, and lowering of the amount of the water-soluble component due to appropriate hydrophobic property of the particles.

The self-dispersing polymer particles in the invention can be formed by using, for example, a constituent unit derived from an aromatic group-containing monomer and a constituent unit derived from a dissociative group-containing monomer. The polymer particles may further contain additional constituent unit(s) optionally.

The monomer which may be used for forming the additional constituent unit is not particularly limited so long as it is a monomer copolymerizable with the aromatic group-containing monomer and the dissociative group-containing monomer. Among all, an alkyl group-containing monomer is preferred from a viewpoint of the flexibility of the polymer skeleton or easiness in control for the glass transition temperature (Tg).

Examples of the alkyl group-containing monomer include alkyl(meth)acrylates such as methyl(meth)acrylate, ethyl (meth)acrylate, isopropyl(meth)acrylate, n-propyl(meth) acrylate, n-butyl(meth)acrylate, isobutyl(meth)acrylate, t-butyl(meth)acrylate, hexyl(meth)acrylate, and ethylhexyl (meth)acrylate; ethylenically unsaturated monomers having a hydroxyl group such as hydroxymethyl(meth)acrylate, 2-hydroxyethyl(meth)acrylate, 2-hydroxypropyl(meth)acrylate, 4-hydroxybutyl(meth)acrylate, hydrorxypentyl(meth)acrylate, and hydroxyhexyl(meth)acrylate; dialkylamino alkyl (meth)acrylates such as dimethylaminoethyl(meth)acrylate; (meth)acrylamides, for example, N-hydroxyalkyl(meth) acrylamide such as N-hydroxymethyl(meth)acrylamide, N-hydroxyethyl(meth)acrylamide, and N-hydroxybutyl (meth)acrylamide; and N-alkoxyalkyl(meth)acrylamides such as N-methoxymethyl(meth)acrylamide, N-ethoxymethyl(meth)acrylamide, N-(n-, iso)butoxymethyl(meth)acrylamide, N-methoxyethyl(meth)acrylamide, N-ethoxyethyl (meth)acrylamide, and N-(n-, iso)butoxyethyl(meth) acrylamide.

The range for the molecular weight of the water-insoluble polymer that is used in the self-dispersing polymer particles in the invention is, preferably, from 3,000 to 200,000 and, more preferably, from 5,000 to 150,000 and, further preferably, from 10,000 to 100,000 as the weight average molecular weight. The amount of the water-soluble component can be suppressed effectively when the weight average molecular weight is 3,000 or more. Further, the self-dispersion stability can be increased when the weight average molecular weight is 200,000 or less.

The weight average molecular weight is measured by gel permeation chromatography (GPC). In GPC, HLC-8020GPC (manufactured by Tosoh Corporation) is used, and 3 pieces of columns of TSKgel Super HZM-H, TSK gel Super HZ4000 and TSK gel Super HZ200 (trade names, manufactured by Tosoh Corporation, 4.6 mm ID×15 cm) were used, and THF (tetrahydrofuran) is used as an eluate. Measurement is performed by using an IR detector under the conditions at a sample concentration of 0.35 mass %, a flow rate of 0.35 mL/min, a sample ejection amount of 10 μL, and a measuring temperature of 40° C. A calibration curve is prepared based on eight samples of "standard sample: TSK standard polystyrene" of "F-40", "F-20", "F-4", "F-1", "A-5000", "F-2500", "A-1000", and "n-propylbenzene" manufactured by Tosoh Corporation.

The water-insoluble polymer used for the self-dispersing polymer particle in the invention preferably contains a structural unit derived from an aromatic group-containing (meth) acrylate monomer (preferably, structural unit derived from phenoxyethyl(meth)acrylate and/or structural unit derived from benzyl(meth)acrylate) in an amount of from 15 to 80 mass % as the copolymerization ratio based on the entire mass of the self-dispersing polymer particles from a viewpoint of controlling the hydrophilicity and hydrophobicity of the polymer.

Further, the water-insoluble polymer preferably contains a constituent unit derived from an aromatic group-containing (meth)acrylate monomer in an amount of from 15 to 80 mass % as the copolymerization ratio, a constituent unit derived from a carboxyl group-containing monomer, and a constituent unit derived from an alkyl group-containing monomer (preferably, constituent unit derived from (meth)acrylic acid alkyl ester). The water-insoluble polymer more preferably contains a structural unit derived from phenoxyethyl(meth) acrylate and/or structural unit derived from benzyl(meth) acrylate in an amount of from 15 to 80 mass % as the copolymerization ratio, a constituent unit derived from a carboxyl group-containing monomer, and a constituent unit derived from an alkyl group-containing monomer (preferably, a structural unit derived from an ester of alkyl having 1 to 4 carbon atoms of (meth)acrylic acid). Further, the water-insoluble polymer has preferably an acid value of from 25 to 100 and a weight average molecular weight of from 3,000 to 200,000 and, more preferably, an acid value of from 25 to 95 and a weight average molecular weight of from 5,000 to 150,000, from a viewpoint of controlling the hydrophilicity and hydrophobicity of the polymer.

As specific examples of the water-insoluble polymer that is used in the self-dispersing polymer particles, exemplary compounds B-01 to B-19 are shown below but in the invention the water-insoluble polymer is not limited to them. Numericals described in each parenthesis represents the mass ratio of the copolymer components.

B-01: phenoxyethyl acrylate/methyl methacrylate/acrylic acid copolymer (50/45/5)

B-02: phenoxyethyl acrylate/benzyl methacrylate/isobutyl methacrylate/methacrylic acid copolymer (30/35/29/6)

B-03: phenoxyethyl methacrylate/isobutyl methacrylate/methacrylic acid copolymer (50/44/6)

B-04: phenoxyethyl acrylate/methyl methacrylate/ethyl acrylate/acrylic acid copolymer (30/55/10/5)

B-05: benzyl methacrylate/isobutyl methacrylate/methacrylic acid copolymer (35/59/6)

B-06: styrene/phenoxyethyl acrylate/methyl methacrylate/acrylic acid copolymer (10/50/35/5)

B-07: benzyl acrylate/methyl methacrylate/acrylic acid copolymer (55/40/5)

B-08: phenoxyethyl methacrylate/benzyl acrylate/methacylic acid copolymer (45/47/8)

B-09: styrene/phenoxyethyl acrylate/butyl methacrylate/acrylic acid copolymer (May 48, 1940/7)

B-10: benzyl methacrylate/isobutyl methacrylate/cyclohexyl methacrylate/methacrylic acid copolymer (35/30/30/5)

B-11: phenoxyethyl acrylate/methyl methacrylate/butyl acrylate/methacrylic acid copolymer (12/50/30/8)

B-12: benzyl acrylate/isobutyl methacrylate/acrylic acid copolymer (93/2/5)

B-13: styrene/phenoxyethyl methacrylate/butyl acrylate/acrylic acid copolymer (50/5/20/25)

B-14: styrene/butyl acrylate/acrylic acid copolymer (62/35/3)

B-15: methyl methacrylate/phenoxyethyl acrylate/acrylic acid copolymer (45/51/4)

B-16: methyl methacrylate/phenoxyethyl acrylate/acrylic acid copolymer (45/49/6)

B-17: methyl methacrylate/phenoxyethyl acrylate/acrylic acid copolymer (45/48/7)

B-18: methyl methacrylate/phenoxyethyl acrylate/acrylic acid copolymer (45/47/8)

B-19: methyl methacrylate/phenoxyethyl acrylate/acrylic acid copolymer (45/45/10)

The method of producing a water-insoluble polymer that is used in the self-dispersing polymer particle in the invention is not particularly limited. Examples of the method of producing the water-insoluble polymer include a method of performing emulsion polymerization under the presence of a polymerizable surfactant thereby covalently-bonding the surfactant and the water-insoluble polymer and a method of copolymerizing a monomer mixture containing the hydrophilic group-containing monomer and the aromatic group-containing monomer by a known polymerization method such as a solution polymerization method or a bulk polymerization method. Among the polymerization methods described above, the solution polymerization method is preferred and a solution polymerization method of using an organic solvent is more preferred from a viewpoint of aggregation speed and the stability of droplet ejection of the ink composition.

From a viewpoint of the aggregation speed, it is preferred that the self-dispersing polymer particles in the invention contain a polymer synthesized in an organic solvent, and the polymer has a carboxyl group (the acid value is preferably from 20 to 100), in which the carboxyl groups of the polymer are partially or entirely neutralized and the polymer is prepared as a polymer dispersion in a continuous phase of water. That is, the self-dispersing polymer particle in the invention is prepared by a method including a step of synthesizing the polymer in the organic solvent and a dispersion step of forming an aqueous dispersion in which at least a portion of the carboxyl groups of the polymer is neutralized.

The dispersion step preferably includes the following step (1) and step (2).

Step (1): step of stirring a mixture containing a polymer (water-insoluble polymer), an organic solvent, a neutralizing agent, and an aqueous medium, Step (2): step of removing the organic solvent from the mixture.

The step (1) preferably a treatment that includes at first dissolving the polymer (water-insoluble polymer) in the organic solvent and then gradually adding the neutralizing agent and the aqueous medium, and mixing and stirring the mixture to obtain a dispersion. By adding the neutralizing agent and the aqueous medium to the solution of the water-insoluble polymer dissolved in the organic solvent, self-dispersing polymer particles having a particle size that enables higher storage stability can be obtained without requiring strong sharing force.

The stirring method for stirring the mixture is not particularly limited and a mixing and stirring apparatus that is used generally can be used, and optionally, a disperser such as a ultrasonic disperser or a high pressure homogenizer can be used.

Preferable examples of the organic solvent include alcohol type solvents, ketone type solvents and ether type solvents.

Examples of the alcohol type solvent include isopropyl alcohol, n-butanol, t-butanol, and ethanol. Examples of the ketone type solvent include acetone, methyl ethyl ketone, diethyl ketone, and methyl isobutyl ketone. Examples of the ether type solvent include dibutyl ether and dioxane. Among the solvents, the ketone type solvent such as methyl ethyl ketone and the alcohol type solvent such as propyl alcohol are preferred. Further, with an aim of moderating the change of polarity at the phase transfer from an oil system to an aqueous system, combined use of isopropyl alcohol and methyl ethyl ketone is also preferred. By the combined use of the solvents, self-dispersing polymer particles of small particle size with no aggregation settling or fusion between particles to each other and having high dispersion stability may be obtained.

The neutralizing agent is used to partially or entirely neutralize the dissociative groups so that the self-dispersing polymer can form a stable emulsified or dispersed state in water. In a case where the self-dispersing polymer of the invention has an anionic dissociative group (for example, carboxyl group) as the dissociative group, examples of the neutralizing agent to be used include basic compounds such as organic amine compounds, ammonia, and alkali metal hydroxides. Examples of the organic amine compounds include monomethyl amine, dimethyl amine, trimethyl amine, monoethyl amine, diethyl amine, triethyl amine, monopropyl amine, dipropyl amine, monoethanol amine, diethanol amine, triethanol amine, N,N-dimethyl-ethanol amine, N,N-diethyl-ethanol amine, 2-diethylamino-2-methyl-1-propanol, 2-amino-2-methyl-1-propanol, N-methyldiethanol amine, N-ethyldiethanol amine, monoisopropanol amine, diisopropanol amine, and triisopropanol amine, etc. Examples of the alkali metal hydroxide include lithium hydroxide, sodium hydroxide and potassium hydroxide. Among them, sodium hydroxide, potassium hydroxide, triethylamine, and triethanol amine are preferred from a viewpoint of the stabilization of dispersion of the self-dispersing polymer particles of the invention into water.

The basic compound is used preferably in an amount of from 5 to 120 mol %, more preferably, from 10 to 110 mol %, and further preferably, from 15 to 100 mol %, relative to 100 mol % of the dissociative groups. When the basic compound is used in an amount of 15 mol % or more, the effect of stabilizing the dispersion of the particles in water may be obtained and when the basic compound is in an amount of 100% or less, the effect of decreasing the water-soluble component may be provided.

In the step (2), an aqueous dispersion of the self-dispersing polymer particles can be obtained by phase transfer to the aqueous system by distilling off the organic solvent from the dispersion obtained in the step (1) by a common method such as distillation under a reduced pressure. In the obtained aqueous dispersion, the organic solvent has been substantially removed and the amount of the organic solvent is preferably from 0.2 mass % or less and, more preferably, 0.1 mass % or less.

The weight average molecular weight of the resin particles is preferably 10,000 or more and 200,000 or less, and more preferably 100,000 or more and 200,000 or less.

The average particle size of the resin particles (latex particles) is, as a volume average particle size, preferably in the range of 10 nm to 1 μm, more preferably in the range of from 10 nm to 200 nm, even more preferably in the range of from 20 nm to 100 nm, and particularly preferably in the range of from 20 nm to 50 nm. When the volume average particle size is 10 nm or more, production suitability may be enhanced, and when the volume average particle size is 1 μm or less, storage stability may be enhanced.

The particle size distribution of the resin particles is not particularly limited, and any of those particles having a broad particle size distribution or those particles having a monodisperse particle size distribution may be used. Two or more kinds of water-insoluble particles may be used as mixtures.

The average particle size and particle size distribution of the resin particles are determined by measuring the volume average particle size by a dynamic light scattering method, using a NANOTRACK particle size distribution analyzer (model name: UPA-EX150, manufactured by Nikkiso Co., Ltd.).

The glass transition temperature (Tg) of the resin particles is preferably 30° C. or higher, more preferably 40° C. or higher, and even more preferably 50° C. or higher, from the viewpoint of the storage stability of the aqueous ink.

The particle size distribution of the resin particles is not particularly limited, and any of those particles having a broad particle size distribution or those particles having a monodisperse particle size distribution may be used. A mixture of two or more species of resin particles having a monodisperse particle size distribution may also be used.

The resin particles (particularly, the self-dispersing polymer particles) may be used as one kind alone, or as mixtures of two or more kinds.

The content of the resin particles in the aqueous ink is preferably 0.5 to 20% by mass, more preferably 3 to 20% by mass, and even more preferably 5 to 15% by mass, relative to the total mass of the aqueous ink.

<Surfactant>

The aqueous ink according to the invention may contain a surfactant, if necessary. The surfactant may be used as a surface tension adjusting agent.

As the surface tension adjusting agent, a compound having a structure in which a hydrophilic moiety and a hydrophobic moiety are contained in the molecule may be effectively used, and any of anionic surfactants, cationic surfactants, amphoteric surfactants, nonionic surfactants, and betaine surfactants may be used. Further, the dispersants (polymeric dispersant) as described above may be used as surfactants.

Specific examples of the anionic surfactants include sodium dodecyl benzenesulfonate, sodium lauryl sulfate, sodium alkyl diphenyl ether disulfonates, sodium alkylnaphthalenesulfonates, sodium dialkylsulfosuccinates, sodium stearate, potassium oleate, sodium dioctylsulfosuccinate, sodium polyoxyethylene alkyl ether sulfonates, sodium polyoxyethylene alkyl ether sulfates, sodium polyoxyethylene alkyl phenyl ether sulfates, sodium dialkylsulfosuccinates, sodium stearate, sodium oleate, t-octylphenoxyethoxypolyethoxyethyl sulfuric acid sodium salt. Only one of these compound may be selected or two or more of these compounds may be selected.

Specific examples of the nonionic surfactants include polyoxyethylene lauryl ether, polyoxyethylene octyl phenyl ether, polyoxyethylene oleyl phenyl ether, polyoxyethylene nonyl phenyl ether, oxyethylene oxypropylene block copolymers, t-octylphenoxyethylpolyethoxyethanol, nonylphenoxyethylpolyethoxyethanol. Only one of these compounds may be selected or two or more of these compounds may be selected.

Specific examples of the cationic surfactants include tetraalkylammonium salts, alkylamine salts, benzalkonium salts, alkylpyridium salts, imidazolium salts. Specifically, examples thereof include dihydroxyethylstearylamine, 2-heptadecenylhydroxyethylimidazoline, lauryldimethylbenzylammonium chloride, cetylpyridinium chloride, stearamidomethylpyridium chloride.

In the case where the aqueous ink contains a surfactant (surface tension adjusting agent), it is preferable that the surfactant be contained in an amount such that the surface tension of the aqueous ink may be adjusted to 20 to 60 mN/m, in view of performing the ejection of the aqueous ink satisfactorily by an ink-jet method, and more preferably to a surface tension of 20 to 45 mN/m, and even more preferably 25 to 40 mN/m.

The specific amount of the surfactant in the aqueous ink is not particularly limited, and may be an amount to obtain a surface tension in the preferable range. The amount of the surfactant(s) is preferably 1% by mass or more, more preferably 1 to 10% by mass, and even more preferably 1 to 3% by mass.

<Other Components>

The aqueous ink may further contain various additives as other components according to necessity, in addition to the components described above.

Examples of the various additives include those known additives such as an ultraviolet absorbent, a fading preventing agent, an anti-mold agent, a pH adjusting agent, an anti-rust agent, an antioxidant, an emulsion stabilizer, a preservative, an antifoaming agent, a viscosity adjusting agent, a dispersion stabilizer, and a chelating agent.

Examples of the ultraviolet absorbent include benzophenone-based ultraviolet absorbents, benzotriazole-based ultraviolet absorbents, salicylate-based ultraviolet absorbents, cyanoacrylate-based ultraviolet absorbents, and nickel complex salt-based ultraviolet absorbents.

As the fading preventing agent, any of various organic fading preventing agents and metal complex-based fading preventing agents may be used. Examples of the organic fading preventing agent include hydroquinones, alkoxyphenols, dialkoxyphenols, phenols, anilines, amines, indanes, chromans, alkoxyanilines, and heterocycles. Examples of the metal complex include nickel complexes, and zinc complexes.

Examples of the anti-mold agent include sodium dehydroacetate, sodium benzoate, sodium pyridinethione-1-oxide, p-hydroxybenzoic acid ethyl ester, 1,2-benzisothiazolin-3-one, sodium sorbate, pentachlorophenol sodium.

The content of the anti-mold agent in the aqueous ink is preferably in the range of 0.02 to 1.00% by mass.

The pH adjusting agent is not particularly limited as long as the agent may adjust the pH to a desired value without exerting any adverse effects on the aqueous ink to be prepared, and may be appropriately selected according to the purpose. Examples thereof include alcohol amines (for example, diethanolamine, triethanolamine, 2-amino-2-ethyl-1,3-propanediol), alkali metal hydroxides (for example, lithium hydroxide, sodium hydroxide, potassium hydroxide), ammonium hydroxides (for example, ammonium hydroxide, quaternary ammonium hydroxide), phosphonium hydroxide, alkali metal carbonates.

Examples of the anti-rust agent include acidic sulfurous acid salts, sodium thiosulfate, ammonium thiodiglycolate, diisopropylammonium nitrite, pentaerythritol tetranitrate, dicyclohexylammonium nitrite.

Examples of the antioxidant include phenol-based antioxidants (including hindered phenol-based antioxidants), amine-based antioxidants, sulfur-based antioxidants, phosphorus-based antioxidants, Examples of the chelating agent include sodium ethylenediaminetetraacetate, sodium nitrilotriacetate, sodium hydroxyethylethylenediaminetriacetate, sodium diethylenetriaminepentaacetate, sodium uramyldiacetate.

—Properties of Aqueous Ink—

The surface tension (25° C.) of the aqueous ink according to the invention is preferably 20 mN/m or more and 60 mN/m or less. More preferably, the surface tension is 20 mN/m or more and 45 mN/m or less, and even more preferably 25 mN/m or more and 40 mN/m or less.

The surface tension of the aqueous ink is measured under the conditions of 25° C. using an automatic surface tension meter (model name: CBVP-Z, manufactured by Kyowa Interface Science Co., Ltd.).

The viscosity at 25° C. of the aqueous ink composition according to the invention is preferably 1.2 mPa·s or more and 15.0 mPa·s or less, more preferably 2 mPa·s or more and less than 13 mPa·s, and even more preferably 2.5 mPa·s or more and less than 10 mPa·s.

The viscosity of the aqueous ink is measured under the conditions of 25° C. using a viscometer (model name: TV-22, manufactured by Toki Sangyo Co., Ltd.).

—Other Steps—

The ink-jet recording method of the invention may include other steps (additional step(s)) according to necessity, in addition to the treatment liquid supplying step and the image recording step.

The additional steps are not particularly limited, and for example, an ink drying step for removing by drying the organic solvent in the aqueous ink supplied to the art paper or coat paper, a heating and fixing step for melting and fixing the resin particles or polymer latex contained in the aqueous ink may be appropriately selected according to the purpose.

The ink drying step may be constituted to be similar to the drying and removal step, which may be provided in the treatment liquid supplying step, and the method thereof is not particularly limited as long as it involves a method capable of removing by drying at least a part of the solvent in the aqueous ink. Specifically, the step may be carried out by applying a generally used method, such as heating or air blowing (feeding of dry air) to the image area. This ink drying step is more preferably provided after the step of supplying the aqueous ink, from the viewpoint of suppressing the occurrence of curling or cockling, and enhancing the abrasion resistance of images.

The heating and fixing step is not particularly limited as long as it involves a method capable of melting and fixing the resin particles contained in the aqueous ink, and may be appropriately selected according to the purpose.

EXAMPLES

Hereinafter, the present invention will be described in detail by way of examples but the invention is not limited to the following examples so long as they are within the gist of the invention. Here, unless stated otherwise, the "part" is on a mass basis.

Examples 1 to 14 and Comparative Examples 1 to 11

Preparation of Ink (1) Preparation of Cyan Pigment Ink C

—Preparation of Pigment Dispersion Liquid—

10 g of CYANINE BLUE A-22 (PB 15:3, manufactured by Dainichiseika Color & Chemicals Manufacturing Co., Ltd.) as a colorant, 10.0 g of the low molecular weight dispersant 2-1 shown below, 4.0 g of glycerin, and 26 g of ion-exchanged water were mixed while the mixture was stirred, and thus a crude dispersion was obtained. Subsequently, the resulting crude dispersion was subjected to intermittent ultrasonication (ultrasonication was applied for 0.5 seconds and paused for 1.0 second) for two hours, using an ultrasonicator (trade name: VIBRA-CELL VC-750, manufactured by Sonics & Materials, Inc.; tapered microtip: ϕ5 mm, amplitude: 30%), to further disperse the pigment, and a 20% pigment dispersion liquid was obtained.

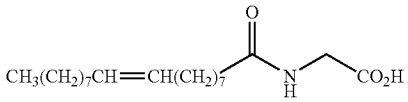

Low molecular weight dispersant 2-1

—Preparation of Ink—

<Preparation of Mixed Liquid I>

Apart from the preparation described above, the compounds of the composition shown below were weighed and then mixed while stirred, to prepare a mixed liquid I.

—Composition—

| | |
|---|---|
| Dipropylene glycol (water-soluble organic solvent) | 5.0 g |
| Diethylene glycol (water-soluble organic solvent) | 10.0 g |
| OLFINE E 1010 (nonionic surfactant, manufactured by Nisshin Chemical Industry Co., Ltd.) | 1.1 g |
| Ion-exchanged water | 10.9 g |

<Preparation of Self-Dispersing Polymer Particles>

In a 2-liter three-necked flask equipped with a stirrer, a thermometer, a reflux cooling tube and a nitrogen gas inlet tube, 360.0 g of methyl ethyl ketone was introduced and the temperature was raised to 75° C. While the temperature of the inside of the reaction vessel was maintained at 75° C., a mixed solution of 180.0 g of phenoxyethyl acrylate, 162.0 g of methyl methacrylate, 18.0 g of acrylic acid, 72 g of methyl ethyl ketone, and 1.44 g of "V-601" (manufactured by Wako Pure Chemical Industries, Ltd.), was added dropwise to the flask at a constant rate, such that the dropwise addition was completed in two hours. After completion of the dropwise addition, a solution of 0.72 g of "V-601" and 36.0 g of methyl ethyl ketone was added, and the mixture was stirred for two hours at a temperature of 75° C. Then, a solution of 0.72 g of "V-601" and 36.0 g of isopropanol was further added, and the mixture was stirred for two hours at a temperature of 75° C., after which the temperature was raised to 85° C., and the mixture was continuously stirred for additional two hours. Accordingly a polymer solution was obtained. The weight average molecular weight (Mw) of the resulting copolymer was 64,000 (measured by gel permeation chromatography (GPC) and calculated based on polystyrene standards; the column used was TSK-GEL SUPER HZM-H, TSK-GEL SUPER HZ4000, TSK-GEL SUPER HZ200 (manufactured by Tosoh Corp.)), and the acid value was 38.9 (mg KOH/g).

Subsequently, 668.3 g of the thus obtained polymer solution was weighed, and to this 668.3 g of the polymer solution in the reaction vessel, 388.3 g of isopropanol, and 145.7 ml of a 1 mol/L aqueous solution of NaOH were added. The temperature of the inside of the reaction vessel was raised to 80° C. Subsequently, 720.1 g of distilled water was added dropwise at a rate of 20 ml/min, to disperse the reaction mixture in water. Thereafter, under the atmospheric pressure, the temperature of the inside of the reaction vessel was maintained at 80° C. for 2 hours, at 85° C. for 2 hours, and at 90° C. for 2 hours. Subsequently, the pressure of the inside of the reaction vessel was reduced, and 913.7 g in total of isopropanol, methyl ethyl ketone and distilled water was distilled off, to obtain an aqueous dispersion (emulsion) of self-dispersing polymer particles (B-01) at a solids concentration of 28.0%.

Here, the structure of the self-dispersing polymer particles (B-01) was as shown below. The numeral at the lower right corner of the respective constituent units in the following structure represents the "mass ratio."

(B-01)

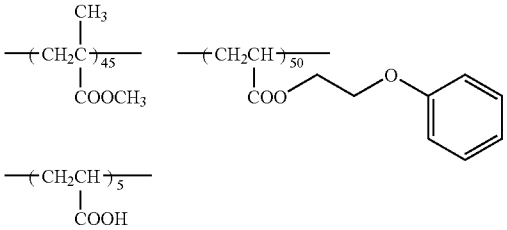

<Preparation of Ink>

The mixed liquid I obtained as described above was slowly added dropwise to 36.2 g of the aqueous dispersion of self-dispersing polymer particles (B-01) at a solid concentration of 28.0%, which was kept stirred, and the mixture was stirred to mix, to prepare a mixed liquid II. While the resulting mixed liquid II was slowly added dropwise to the 20% pigment dispersion liquid obtained as described above, the mixture was stirred to mix. Thus, 100 g of an ink composition, cyan pigment ink C (cyan ink), was prepared.

The pH of the cyan pigment ink C was measured using a pH meter (trade name: WM-50EG, manufactured by DKK-Toa Corp.), and the pH value was 8.5.

(2) Preparation of Magenta Pigment Ink M

A magenta pigment ink M (magenta ink) was prepared by the same method as that used in the preparation of the cyan pigment ink C, except that the CYANINE BLUE A-22 used as a pigment in the preparation of the cyan pigment ink C was replaced with CROMOPHTAL JET MAGENTA DMQ (PR-122, manufactured by Ciba Specialty Chemicals, Inc.).

The pH of the magenta pigment ink M was measured using a pH meter (trade name WM-50EG, manufactured by DKK-Toa Corp.), and the pH value was 8.5.

(3) Preparation of Yellow Pigment ink Y

A yellow pigment ink Y (yellow ink) was prepared by the same method as that used in the preparation of the cyan pigment ink C, except that the CYANINE BLUE A-22 used as a pigment in the preparation of the cyan pigment ink C was replaced with IRGALITE YELLOW GS (PY 74, manufactured by Ciba Specialty Chemicals, Inc.).

The pH of the yellow pigment ink Y was measured using a pH meter (trade name WM-50EG, manufactured by DKK-Toa Corp.), and the pH value was 8.5.

(4) Preparation of Black Pigment Ink K

A black pigment ink K (black ink) was prepared by the same method as that used in the preparation of the cyan pigment ink C, except that a pigment dispersion, CAB-O-JET™ 200 (carbon black, manufactured by Cabot Corp.), was used in place of the pigment dispersion liquid prepared in the preparation of the cyan pigment ink C.

The pH of the black pigment ink K was measured using a pH meter (trade name WM-50EG, manufactured by DKK-Toa Corp.), and the pH value was 8.5.

<Preparation of Aqueous Treatment Liquid>

(Treatment Liquid 1)

A treatment liquid 1 was prepared by mixing the components of the following composition. The viscosity (25° C.) of the treatment liquid 1 measured by a viscometer (trade name: TV-22, manufactured by Toki Sangyo Co., Ltd.) was 2.5 mPa·s.

<Composition>

| | |
|---|---|
| Malonic acid (fixing agent) | 13 g |
| Diethylene glycol monoethyl ether | 20 g |
| Ion-exchanged water | 67 g |

(Treatment Liquid 2)

A treatment liquid 2 was prepared by mixing the components of the following composition. The viscosity (25° C.) of the treatment liquid 2 measured by the method as described above was 2.9 mPa·s.

<Composition>

| | |
|---|---|
| Malonic acid (fixing agent) | 25 g |
| Diethylene glycol monoethyl ether | 20 g |
| Ion-exchanged water | 55 g |

(Treatment Liquid 3)

A treatment liquid 3 was prepared by mixing the components of the following composition. The viscosity (25° C.) of the treatment liquid 3 measured by the method as described above was 2.5 mPa·s.

<Composition>

| | |
|---|---|
| Calcium nitrate | 10 g |
| Diethylene glycol monoethyl ether | 15 g |
| OLFINE E 1010 (manufactured by Nisshin Chemical Industry Co., Ltd.) | 1 g |
| Ion-exchanged water | 74 g |

(Treatment Liquid 4)

A treatment liquid 4 was prepared by mixing the components of the following composition. The viscosity (25° C.) of the treatment liquid 4 measured by the method as described above was 8.1 mPa·s.

<Composition>

| | |
|---|---|
| Malonic acid (fixing agent) | 25 g |
| Triethylene glycol monobutyl ether | 35 g |
| OLFINE E 1010 (manufactured by Nisshin Chemical Industry Co., Ltd.) | 1 g |
| Ion-exchanged water | 39 g |

<Image Recording>

As recording media (coated papers), U-LITE (basis weight 104.7 g/m$^2$), TOKUBISHI ART (basis weight 104.7 g/m$^2$), and OK TOPCOAT+(basis weight 104.7 g/m$^2$) were provided as indicated in the following Tables 1-1 and 1-2. The type, amount of supplying and the like of the aqueous treatment liquids were varied as indicated in the following Tables 1-1 and 1-2, and images were recorded as will be described below.

[Droplet Ejection Method]

Recording of line images and solid images by four color single pass recording were performed, using the cyan pigment ink C, the magenta pigment ink M, the yellow pigment ink Y, and the black pigment ink K obtained as described above as aqueous inks, together with the aqueous treatment liquids indicated in the following Tables 1-1 and 1-2. In this case, with respect to the line images, a line of 1-dot width, a line of 2-dot width and a line of 4-dot width, at 1200 dpi, were recorded by ejecting the aqueous ink by the single pass mode in the main scanning direction. The solid image was recorded by ejecting the aqueous ink over the entire surface of a sample of a recording medium cut to A5 size. Here, the general conditions for the process of recording are as follows.

[Recording]

(1) Treatment Liquid Supplying Step

First, the treatment liquid was coated over the entire surface of the recording medium by means of a roll coater with the amount of application controlled by an anilox roller (number of lines 100 to 300/inch), such that the amount of supply was the value indicated in the following Tables 1-1 and 1-2.

(2) Drying and Removal Step

Subsequently, the recording medium coated with the treatment liquid was dried under the following conditions.

Air speed: 15 m/s

Temperature: The recording medium was heated with a contact type plate heater from the opposite side of the recorded surface (rear side) such that the surface temperature on the recorded surface side of the recording medium became 60° C.

Range of air blowing: 450 mm (drying time 0.7 seconds)

(3) Image Recording Step

Thereafter, a line image and a solid image were recorded on the coated surface of the recording medium coated with the aqueous treatment liquid, by ejecting the aqueous ink by an ink-jet method under the conditions described below.

Head: Piezo full line heads of 1,200 dpi/20 inch width were arranged for 4 colors.

Amount of ejected droplets: Four values were recorded for 0 pL, 2.0 pL, 3.5 pL and 4.0 pL.

Operating frequency: 30 kHz (conveyance speed for the recording medium 635 mm/sec)

(4) Ink Drying and Removal Step

Subsequently, the recording medium supplied with the aqueous ink was dried under the conditions described below.

Drying method: air blown drying

Air speed: 15 m/s

Temperature: The recording medium was heated with a contact type plate heater from the opposite side of the recorded surface (rear side) such that the surface temperature on the recorded surface side of the recording medium became 60° C.

Range of air blowing: 640 mm (drying time 1 second)

(5) Fixing Step

Subsequently, a heating and fixing treatment was carried out by passing the recording medium through a pair of rollers under the conditions described below.

Silicone rubber roller (hardness 50°, nip width 5 mm)

Roller temperature: 70° C.

Pressure: 0.8 MPa

<Evaluation>

The following evaluation was performed on the line images and solid images recorded as described above. The evaluation results are presented in the following Tables 1-1 and 1-2.

—Density Irregularity—

The uniform image area obtained by solid image recording performed with the cyan pigment ink C on a solid image formed with the magenta pigment ink M, was observed by visual observation, and the degree of density irregularity was evaluated according to the following evaluation criteria.

<Evaluation Criteria>

A: No irregularity is observed, and the density of the solid image area is uniform.

B: Slight irregularity is observed in some parts, but the irregularity was at a practically non-problematic level.

C: Irregularity is observed, and the irregularity is at a minimum tolerable level for practical application.

D: Significant irregularity is observed, and the irregularity is at a level with very low practicality.

—Image Quality (Printing Performance)—

Printing performance was evaluated according to the following evaluation criteria, with respect to the line of 1-dot width, the line of 2-dot width, and the line of 4-dot width recorded on the recording medium.

<Evaluation Criteria>

A: All lines are uniform lines.

B: The line of 1-dot width is uniform, but non-uniformity in the line width or break in the line is observed in some parts of the line of 2-dot width and the line of 4-dot width.

C: The line of 1-dot width is uniform, but non-uniformity in the line width or break in the line is observed in the overall part of the line of 2-dot width and the line of 4-dot width.

D: Non-uniformity in the line width or break in the line is observed significantly in the overall part of the lines.

—Surface Gloss—

The 60° specular gloss of the surfaces of an unrecorded recording medium and a non-image area (area having ink thereon in the recording medium on which image recording had been carried out) was measured with a glossimeter (trade name: IG-331, manufactured by Horiba, Ltd.). A smaller range of fluctuation in the surface gloss between the unrecorded recording medium and the non-image area indicates that the image is more satisfactory.

<Evaluation Criteria>

A: Fluctuation of ±5% or less with respect to the glossiness of the unrecorded recording medium B: Fluctuation of more than ±5% and ±10% or less with respect to the glossiness of the unrecorded recording medium C: Fluctuation of more than ±10% and ±20% or less with respect to the glossiness of the unrecorded recording medium D: Fluctuation of more than ±20% with respect to the glossiness of the unrecorded recording medium —Abrasion Resistance (1)—

Immediately after printing a solid image of 2 cm square on a recording medium, an unrecorded recording medium (the same recording medium as that used for recording (hereinafter, referred to as an unused sample in regard to the current evaluation)) was placed on the recording medium having the solid image of 2 cm square thereon, and was rubbed thereagainst reciprocatingly (back and forth) 10 times with a load of 150 kg/m$^2$. The degree of transfer of ink to the blank area of the unused sample was visually observed, and was evaluated according to the following evaluation criteria.

<Evaluation Criteria>

A: There is no transfer of ink at all.

B: Transfer of ink is hardly noticeable.

C: Some level of transfer of ink is observed.

D: Transfer of ink is significant.

Abrasion Resistance (2)—

Immediately after printing a solid image of 10 cm square on a recording medium, as the strength against rubbing, the film strength was measured using an abrasion/rubbing measurement apparatus TRIBOGEAR TYPE:18 (trade name, manufacturer: SHINTO Scientific Co., Ltd.). A needle having a diameter of 0.3 mm was used as the scratching needle, and the measurements were performed for three points, i.e., scratching with a load of 100 g, scratching with a load of 50 g and scratching with a load of 25 g. The resultant recording medium was observed as to whether or not the image film is removed and the blank background of the recording medium is exposed, and was evaluated in accordance with the following evaluation criteria.

<Evaluation Criteria>

A: The blank background of the recording medium is not exposed in the scratched portion even when the recording medium is scratched with a load of 100 g.

B: The blank background of the recording medium is not exposed in the scratched portion when the recording medium is scratched with a load of 50 g.

C: The blank background of the recording medium is not exposed in the scratched portion when the recording medium is scratched with a load of 25 g.

D: The blank background of the recording medium is exposed in the scratched portion even when the recording medium is scratched with a load of 25 g.

TABLE 1-1

| | | | Aqueous treatment liquid | | | Evaluation | | | | |
|---|---|---|---|---|---|---|---|---|---|---|
| | Recording medium | ΔV | Type | Amount of supply [g/m$^2$] | Amount of fixing agent [parts] | Density irregularity | Image quality | Surface gloss | Abrasion resistance test (1) | Abrasion resistance test (2) |
| Example 1 | U-LITE | 1.8 | Treatment liquid 1 | 2.2 | 0.29 | A | B | A | A | A |
| Example 2 | U-LITE | 1.8 | Treatment liquid 1 | 0.95 | 0.12 | B | B | A | A | A |
| Example 3 | U-LITE | 1.8 | Treatment liquid 2 | 2.2 | 0.55 | A | A | A | A | A |
| Example 4 | U-LITE | 1.8 | Treatment liquid 2 | 0.98 | 0.25 | A | A | A | A | A |
| Example 5 | TOKUBISHI ART | 2.5 | Treatment liquid 1 | 2.9 | 0.38 | A | A | A | A | B |
| Example 6 | TOKUBISHI ART | 2.5 | Treatment liquid 1 | 1.3 | 0.17 | B | B | A | A | B |
| Example 7 | TOKUBISHI ART | 2.5 | Treatment liquid 1 | 3.2 | 0.42 | A | A | B | A | B |
| Example 8 | TOKUBISHI ART | 2.5 | Treatment liquid 2 | 2.9 | 0.73 | A | A | A | A | B |
| Example 9 | TOKUBISHI ART | 2.5 | Treatment liquid 2 | 1.8 | 0.45 | A | A | A | A | B |
| Example 10 | TOKUBISHI ART | 2.5 | Treatment liquid 3 | 3.0 | 0.30 | A | B | A | A | B |
| Example 11 | TOKUBISHI ART | 2.5 | Treatment liquid 3 | 1.3 | 0.13 | B | B | A | A | B |
| Example 12 | TOKUBISHI ART | 2.5 | Treatment liquid 4 | 2.9 | 0.73 | B | B | B | A | B |
| Example 13 | OK TOPCOAT+ | 2.0 | Treatment liquid 2 | 2.5 | 0.63 | A | A | A | A | A |
| Example 14 | OK TOPCOAT+ | 2.0 | Treatment liquid 2 | 1.1 | 0.28 | A | A | A | A | A |

TABLE 1-2

| | | | Aqueous treatment liquid | | | Evaluation | | | | |
|---|---|---|---|---|---|---|---|---|---|---|
| | Recording medium | ΔV | Type | Amount of supply [g/m$^2$] | Amount of fixing agent [parts] | Density irregularity | Image quality | Surface gloss | Abrasion resistance test (1) | Abrasion resistance test (2) |
| Comparative example 1 | U-LITE | 1.8 | Treatment liquid 1 | 2.5 | 0.33 | B | C | B | C | C |
| Comparative example 2 | U-LITE | 1.8 | Treatment liquid 1 | 0.85 | 0.11 | D | C | A | A | A |
| Comparative example 3 | U-LITE | 1.8 | Treatment liquid 2 | 2.5 | 0.63 | A | A | C | C | C |
| Comparative example 4 | U-LITE | 1.8 | Treatment liquid 2 | 0.85 | 0.21 | C | C | A | A | A |
| Comparative example 5 | TOKUBISHI ART | 2.5 | Treatment liquid 1 | 3.5 | 0.46 | A | A | D | D | D |
| Comparative example 6 | TOKUBISHI ART | 2.5 | Treatment liquid 1 | 1.0 | 0.13 | D | C | A | A | B |
| Comparative example 7 | TOKUBISHI ART | 2.5 | Treatment liquid 2 | 3.5 | 0.88 | A | A | D | D | D |
| Comparative example 8 | TOKUBISHI ART | 2.5 | Treatment liquid 2 | 1.0 | 0.25 | C | C | A | A | B |
| Comparative example 9 | TOKUBISHI ART | 2.5 | — | — | — | A | D | A | A | A |
| Comparative example 10 | OK TOPCOAT+ | 2.0 | Treatment liquid 2 | 3.2 | 0.80 | A | A | D | D | D |
| Comparative example 11 | OK TOPCOAT+ | 2.0 | Treatment liquid 2 | 0.9 | 0.23 | C | C | A | A | A |

As shown in Tables 1-1 and 1-2, in the Examples, when an art paper or a coat paper was used, line images having uniform widths were obtained, and when solid images were recorded, density irregularity was suppressed, so that uniform and high density images could be obtained. Further, the glossiness of the entire images was satisfactory, and the abrasion resistance thereof was also satisfactory.

By contrast, in the Comparative Examples, density irregularities were worse and the printing performance of the line images was inferior, and the abrasion resistance of the images was also poor. When the amount of aqueous treatment liquid applied was small, prevention of density irregularity worsened and drawing of fine images deteriorated. When the amount of aqueous treatment liquid applied was too large, since the paper surface became rough, glossiness was decreased, and the abrasion resistance of the images also deteriorated.

According to the invention, it is possible to provide an ink-jet recording method by which the appearance of the recording medium, such as glossiness of the recorded surface, is not impaired, and by which drawing of fine lines, fine image portions or the like uniformly, and recording an image excellent in density uniformity can be achieved.

Hereinafter exemplary embodiments of the present invention will be listed. However, the present invention is not limited to the following exemplary embodiments.

<1> An ink-jet recording method comprising:

(i) supplying an aqueous treatment liquid containing a fixing agent for fixing the components contained in an aqueous ink, on an art paper or a coat paper, in an amount of from −50% to +30% with respect to the value of ΔV [ml/m$^2$] determined by the following Formula (I):

$$\Delta V = Vi - Vr \qquad \text{Formula (I)}$$

wherein in Formula (I), Vr represents a roughness index of the art paper or coat paper obtained from a measurement of liquid absorbability according to the Bristow method, and Vi represents an amount of transfer at an inflection point where the value of the absorption coefficient of the art paper or coat paper changes in the measurement of liquid absorbability according to the Bristow method; and (ii) recording an image by ejecting an aqueous ink containing a colorant, resin particles, a water-soluble organic solvent and water, on the art paper or coat paper by an ink-jet method.

<2> The ink-jet recording method of <1>, wherein in the supplying of the aqueous treatment liquid, the aqueous treatment liquid is supplied by coating.

<3> The ink-jet recording method of <1> or <2>, wherein the fixing agent is a di- or higher valent acid.

<4> The ink-jet recording method of any one of <1> to <3>, wherein the fixing agent is supplied in an amount of 0.25 g/m$^2$ or more.

<5> The ink-jet recording method of any one of <2> to <4>, wherein the viscosity at 25° C. of the aqueous treatment liquid is from 2 mPa·s to 8 mPa·s.

<6> The ink-jet recording method of any one of <1> to <5>, wherein the resin particles are acrylic resin particles.

<7> The ink-jet recording method of any one of <1> to <6>, wherein the resin particles are self-dispersing polymer particles.

<8> The ink-jet recording method of <7>, wherein the self-dispersing polymer particles comprise a water-insoluble polymer including a hydrophilic constituent unit and a constituent unit derived from an aromatic group-containing monomer.

<9> The ink-jet recording method of any one of <1> to <8>, wherein in the supplying of the aqueous treatment liquid, the aqueous treatment liquid is supplied onto the coated paper in an amount of from −30% to +20% with respect to ΔV [ml/m$^2$].

<10> The ink-jet recording method of any one of <1> to <8>, wherein in the supplying of the aqueous treatment liquid, the aqueous treatment liquid is supplied onto the coated paper in an amount of from 0.5 to 3.5 ml/m$^2$.

All publications, patent applications, and technical standards mentioned in this specification are herein incorporated by reference to the same extent as if each individual publication, patent application, or technical standard was specifically and individually indicated to be incorporated by reference.

What is claimed is:

1. An ink-jet recording method comprising:

(i) supplying an aqueous treatment liquid containing a fixing agent for fixing the components contained in an aqueous ink, on an art paper or a coat paper, in an amount of from −50% to +30% with respect to the value of ΔV [ml/m$^2$] determined by the following Formula (I):

$$\Delta V = Vi - Vr \qquad \text{Formula (I)}$$

wherein in Formula (I), Vr represents a roughness index of the art paper or coat paper obtained from a measurement of liquid absorbability according to the Bristow method, and Vi represents an amount of transfer at an inflection point where the value of the absorption coefficient of the art paper or coat paper changes in the measurement of liquid absorbability according to the Bristow method; and (ii) recording an image by ejecting an aqueous ink containing a colorant, resin particles, a water-soluble organic solvent and water, on the art paper or coat paper by an ink-jet method.

2. The ink-jet recording method of claim 1, wherein in the supplying of the aqueous treatment liquid, the aqueous treatment liquid is supplied by coating.

3. The ink-jet recording method of claim 1, wherein the fixing agent is a di- or higher valent acid.

4. The ink-jet recording method of claim 1, wherein the fixing agent is supplied in an amount of 0.25 g/m$^2$ or more.

5. The ink-jet recording method of claim 2, wherein the viscosity at 25° C. of the aqueous treatment liquid is from 2 mPa·s to 8 mPa·s.

6. The ink-jet recording method of claim 1, wherein the resin particles are acrylic resin particles.

7. The ink-jet recording method of claim 1, wherein the resin particles are self-dispersing polymer particles.

8. The ink-jet recording method of claim 7, wherein the self-dispersing polymer particles comprise a water-insoluble polymer including a hydrophilic constituent unit and a constituent unit derived from an aromatic group-containing monomer.

9. The ink-jet recording method of claim 1, wherein in the supplying of the aqueous treatment liquid, the aqueous treatment liquid is supplied onto the coated paper in an amount of from −30% to +20% with respect to ΔV [ml/m$^2$].

10. The ink-jet recording method of claim 1, wherein in the supplying of the aqueous treatment liquid, the aqueous treatment liquid is supplied onto the coated paper in an amount of from 0.5 to 3.5 ml/m$^2$.

* * * * *